US008926016B2

(12) United States Patent
Behar et al.

(10) Patent No.: US 8,926,016 B2
(45) Date of Patent: Jan. 6, 2015

(54) SEATING STRUCTURE WITH A CONTOURED FLEXIBLE BACKREST

(71) Applicants: Yves Behar, San Francisco, CA (US); Bret Recor, San Francisco, CA (US); Naoya Edahiro, San Francisco, CA (US); Qin Li, South San Francisco, CA (US); Andrew J. Kurrasch, Saugatuck, MI (US); Christoher C. Hill, Jenison, MI (US); John Matthai, Holland, MI (US); Brock Walker, Okemos, MI (US)

(72) Inventors: Yves Behar, San Francisco, CA (US); Bret Recor, San Francisco, CA (US); Naoya Edahiro, San Francisco, CA (US); Qin Li, South San Francisco, CA (US); Andrew J. Kurrasch, Saugatuck, MI (US); Christoher C. Hill, Jenison, MI (US); John Matthai, Holland, MI (US); Brock Walker, Okemos, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 13/875,893

(22) Filed: May 2, 2013

(65) Prior Publication Data

US 2014/0028061 A1 Jan. 30, 2014

Related U.S. Application Data

(63) Continuation of application No. 13/084,036, filed on Apr. 11, 2011, now Pat. No. 8,449,037.

(60) Provisional application No. 61/390,903, filed on Oct. 7, 2010, provisional application No. 61/323,635, filed on Apr. 13, 2010.

(51) Int. Cl.

| | |
|---|---|
| ***A47C 7/44*** | (2006.01) |
| ***A47C 3/021*** | (2006.01) |
| ***A47C 3/025*** | (2006.01) |
| ***A47C 3/026*** | (2006.01) |
| ***A47C 7/00*** | (2006.01) |
| ***A47C 7/46*** | (2006.01) |
| ***A47C 7/40*** | (2006.01) |
| *A47C 7/28* | (2006.01) |

(52) U.S. Cl.

CPC ... *A47C 7/46* (2013.01); *A47C 7/00* (2013.01); *A47C 7/282* (2013.01); *A47C 7/462* (2013.01); *A47C 7/40* (2013.01)

USPC ..... 297/284.4; 297/284.2; 297/284.7; 297/286; 297/296; 297/297; 297/452.56

(58) Field of Classification Search

USPC ..... 297/284.4, 284.7, 284.2, 286, 296, 297, 297/452.56

See application file for complete search history.

(56) References Cited

U.S. PATENT DOCUMENTS

| | | | | | |
|---|---|---|---|---|---|
| 3,948,558 | A * | 4/1976 | Obermeier et al. | ..... | 297/284.4 |
| 4,730,871 | A * | 3/1988 | Sheldon | ..... | 297/284.7 |
| 5,112,106 | A * | 5/1992 | Asbjornsen et al. | ..... | 297/284.7 |
| 5,975,632 | A * | 11/1999 | Ginat | ..... | 297/284.7 |
| 6,059,362 | A * | 5/2000 | Lin | ..... | 297/284.7 X |
| 6,189,972 | B1 * | 2/2001 | Chu et al. | ..... | 297/284.4 |
| 6,260,921 | B1 * | 7/2001 | Chu et al. | ..... | 297/284.4 |
| 6,354,662 | B1 * | 3/2002 | Su | ..... | 297/284.7 |
| 6,419,318 | B1 * | 7/2002 | Albright | ..... | 297/284.7 |
| 6,588,842 | B2 * | 7/2003 | Stumpf et al. | ..... | 297/284.4 |
| 6,848,744 | B1 * | 2/2005 | Raftery et al. | ..... | 297/284.7 X |

(Continued)

*Primary Examiner* — Rodney B White

(74) *Attorney, Agent, or Firm* — Brinks Gilson & Lione

(57) ABSTRACT

A seating structure includes a backrest member having an upper edge, opposite side edges and a lower edge. The backrest member has a forwardly facing convex shape formed along a vertical centerline thereof between the upper and lower edges. The lower edge has a forwardly facing concave shape. The lower edge has outer portions positioned forwardly of an entirety of the upper edge.

10 Claims, 22 Drawing Sheets

(56) References Cited

U.S. PATENT DOCUMENTS

| | | | | |
|---|---|---|---|---|
| 6,874,852 | B2 * | 4/2005 | Footitt | 297/284.4 |
| 6,910,741 | B2 * | 6/2005 | Footitt | 297/284.4 X |
| 6,957,861 | B1 * | 10/2005 | Chou et al. | 297/284.7 |
| 6,981,743 | B2 * | 1/2006 | Edwards et al. | 297/284.7 |
| 7,104,604 | B1 * | 9/2006 | Kang | 297/284.7 |
| 7,344,194 | B2 * | 3/2008 | Maier et al. | 297/284.7 |
| 7,347,495 | B2 * | 3/2008 | Beyer et al. | 297/284.4 X |
| 7,434,888 | B2 * | 10/2008 | Lin | 297/452.56 |
| 7,484,802 | B2 * | 2/2009 | Beyer et al. | 297/284.4 X |
| 7,731,295 | B2 * | 6/2010 | Lin | 297/452.56 |
| 8,313,143 | B2 * | 11/2012 | Beyer et al. | 297/284.4 X |
| 8,449,037 | B2 * | 5/2013 | Behar et al. | 297/284.4 X |
| 2004/0140701 | A1 * | 7/2004 | Schmitz et al. | 297/284.4 |

* cited by examiner

HORIZONTAL FIG. 33

| STRAND | INSIDE–OUTSIDE WIDTH | BRUSH | CENTER CROSS SECTION | CENTER STRAND THICKNESS (CALCULATION) | CENTER STRAND THICKNESS TARGET | ARMREST CROSS SECTION | ARMREST STRAND THICKNESS (CALCULATION) | ARMREST STRAND THICKNESS TARGET | |
|---|---|---|---|---|---|---|---|---|---|
| H0 | 3.88mm-2.1mm | | | | | | | | |
| H1 | 3.88mm-2.1mm | | 10.5 | 4 | 3.5 | 10.5 | 7.5 | 3.5 | |
| H2 | 3.88mm-2.1mm | | | | | | | | |
| H3 | 3.88mm-2.5mm | | | | | | | | |
| H4 | 3.88mm-2.5mm | | | | | | | | |
| H5 | 3.88mm-2.5mm | | | | | | | | |
| H6 | 3.88mm-2.5mm | | 10.5 | 4 | 3.5 | 10.5 | 6.3 | 3.5 | |
| H7 | 3.88mm-2.5mm | | | | | | | | |
| H8 | 3.88mm-2.5mm | | | | | | | | |
| H9 | 3.88mm-2.9mm | | | | | | 5.4 | 3.5 | |
| H10 | 3.88mm-3.29mm | | 10.5 | 4 | 3.5 | 10.5 | 4.8 | 3.5 | |
| H11 | 3.88mm-3.68mm | | | | | | 4.3 | 3.5 | |
| H12 | 3.88mm-3.88mm | | | | | | | | |
| H13 | 3.88mm-3.88mm | | | | | | | | |
| H14 | 3.88mm-3.88mm | | 13.5 | 5.2 | 4 | 13.5 | 5.2 | 4 | ○ |
| H15 | 3.88mm-3.88mm | | | | | | | | |
| H16 | 3.88mm-3.88mm | | | | | | | | |
| H17 | 3.88mm-3.88mm | | | | | | | | |
| H18 | 5mm-4mm | | 16.25 | | 4.5 | - | | 4.5 | • |
| H19 | 6.6mm-4mm | | 19 | | 4.5 | - | | 4.5 | |
| H20 | 7.4mm-4mm | | 21.75 | | 4.5 | - | | 5 | • |
| H21 | 8.2mm-4mm | | 24.5 | | 4.5 | - | | 5 | |
| H22 | 8.6mm-4mm | | 27.25 | | 4.5 | - | | 5.5 | • |
| H23 | 9mm-4mm | | | | | | | | |
| H24 | 9mm-4mm | | 25 | 4.1 | 5 | 18 | 6.75 | 6 | • |
| H25 | 9mm-4mm | | | | | | | | |
| H26 | 8.2mm-4mm | | 27.9 | 5.1 | 4.5 | - | - | 5.5 | • |
| H27 | 7.4mm-4mm | | 25.8 | 5.2 | 4.5 | - | - | 5 | • |
| H28 | 6mm-3.5mm | | 23.7 | 5.9 | 4.5 | - | - | 4.5 | • |
| H29 | 5mm-3.5mm | | 21.6 | 6.5 | 4.5 | - | - | 4.5 | |
| H30 | 3.88mm-3mm | | | | | | | | |
| H31 | 3.88mm-3mm | | | | | | | | |
| H32 | 3.88mm-3mm | | 19.5 | 7.5 | 4 | | 6.7 | 4 | • |
| H33 | 3.88mm-3mm | | | | | | | | |
| H34 | 3.88mm-3mm | | | | | | | | |
| H35 | 3.88mm-3mm | | | | | | | | |
| H36 | 4.58mm-3.33mm | | 21 | 6.8 | 4 | 12 | 5.4 | 4 | • |
| H37 | 6mm-4mm | | | | | | | | |
| H38 | 6mm-4mm | | 22.5 | 5.6 | 4.5 | 10.5 | 3.9 | 4.5 | • |
| H39 | 6mm-4mm | | | | | | | | |

VERTICAL FIG. 34

| STRAND | INSIDE–OUTSIDE WIDTH | BRUSH | CENTER | | | ARMREST | | |
|---|---|---|---|---|---|---|---|---|
| | | | CROSS SECTION | STRAND THICKNESS (CALCULATION) | STRAND THICKNESS TARGET | CROSS SECTION | STRAND THICKNESS (CALCULATION) | STRAND THICKNESS TARGET |
| V1 | 5mm-5mm | | 15 | 3.8 | 3.5 | 15 | 3.8 | 3.5 |
| V2 | 5.18mm-1.85mm | | - | | | 6 | 4.1 | 3.5 |
| V3 | 5.37mm-1.85mm | | - | | | | 4.1 | 3.5 |
| V4 | 5.53mm-1.85mm | | - | | | | 4.1 | 3.5 |
| V5 | 5.71mm-1.86mm | | - | | | | 4.1 | 3.5 |
| V6 | 5.89mm-2.28mm | | - | | | | 3.35 | 3.5 |
| V7 | 6.07mm-2.28mm | | - | | | | 3.35 | 3.5 |
| V8 | 6.25mm-2.55mm | | - | | | | 3 | 3.5 |
| V9 | 6.42mm-2.8mm | | - | | | | 3.5 | 3.5 |
| V10 | 6.6mm-2.8mm | | 18 | 3.5 | 3.5 | | 3.5 | 3.5 |
| V11 | 6.6mm-2.8mm | | 18 | 3.5 | 3.5 | 6 | 3.5 | 3.5 |
| V12 | 5.815mm-3mm | | 13.5 | 2.95 | 3 | | | 3 |
| V13 | 5.415mm-3mm | | 13.5 | 3.17 | 3 | | | 3 |
| V14 | 4.811mm-3mm | | 13.5 | 3.57 | 3 | | | 3 |
| V15 | 4.811mm-3mm | | 13.5 | 3.57 | 3 | | | 3 |
| V16 | 4.5mm-3mm | | 10.5 | | 3 | | | 3 |
| V17 | 4.2mm-3mm | | 10.5 | | 3 | | | 3 |
| V18 | 3.9mm-3mm | | 10.5 | | 3 | | | 3 |
| V19 | 3.9mm-3mm | | 10.5 | | 3 | | | 3 |
| V20 | 3.6mm-3mm | | 10.5 | 3.7 | 3 | | | 3 |
| V21 | 3.3mm-3mm | | 9 | 3.47 | 3 | | | 3 |
| V22 | | | | | | | | |
| V23 | | | | | | | | |
| V24 | | | | | | | | |
| V25 | | | | | | | | |
| V26 | | | | | | | | |

SEATING STRUCTURE WITH A CONTOURED FLEXIBLE BACKREST

This application is a continuation application of U.S. application Ser. No. 13/084,036, filed Apr. 11, 2011, now U.S. Pat. No. 8,449,037 B2, which application claims the benefit of U.S. Provisional Application No. 61/390,903, filed Oct. 7, 2010, and U.S. Provisional Application No. 61/323,635, filed Apr. 13, 2010, the entire disclosures of which are hereby incorporated herein by reference.

FIELD OF THE INVENTION

The present invention relates generally to a seating structure, and in particular, to a seating structure, such as chair, having a contoured flexible backrest, together with methods of use and assembly.

BACKGROUND

Seating structures may be configured with flexible backrest members, such as polypropylene sheets and woven elastomeric membranes. Typically, the flexible members are put in tension in various ways so as to provide the flexible member with a three-dimensional contour. For example, a peripheral frame may surround and hold the flexible member. In other devices, various portions of the flexible member are held at spaced apart locations, with an intermediate member pushing on the flexible member to form the flexible member and to put portions thereof in tension. Such systems may provide undesirable hard contact points, whether by contact with the frame or by contact with the intermediate member.

SUMMARY

The present invention is defined by the following claims, and nothing in this section should be considered to be a limitation on those claims.

In one aspect, one embodiment of a seating structure includes an upper support member having an upper mounting portion vertically spaced relative to a lower support member. The lower support member includes a pair of spaced apart side mounting portions positioned forwardly of the upper mounting portion and an intermediate mounting portion positioned rearwardly of the side mounting portions. A flexible member has an upper portion connected to the upper mounting portion and a lower portion fixedly connected to the side mounting portions and the middle mounting portion. The flexible member has a forwardly facing concave shape taken along a horizontal plane at a lumbar region of the flexible member and a forwardly facing convex shape taken along a vertical plane at a centerline of the flexible member. The flexible member includes side edges extending and tensioned between the upper mounting portion and the side mounting portions. A tension vector directed away from the upper portion and taken along any point of each of the side edges has a forwardly extending component.

In another aspect, one embodiment of a seating structure includes a backrest member having an upper edge, opposite side edges and a lower edge. The backrest member has a forwardly facing convex shape formed along a vertical centerline thereof between the upper and lower edges. The lower edge has a forwardly facing concave shape. The lower edge is longer than the upper edge and the lower edge has outer portions positioned forwardly of an entirety of the upper edge.

In yet another aspect, a seating structure includes a flexible member made of an elastomeric material having an upper edge, opposite side edges and a lower edge. The flexible member has a forwardly facing convex shape formed along a vertical centerline thereof between the upper and lower edges and a forwardly facing concave shape taken along a horizontal plane at a lumbar region of the flexible member. The flexible member is tensioned along the upper edge from side-to-side, along the lumbar region from side-to-side, and diagonally from end portions of the upper edge to opposite end portions of the lower edge.

In another aspect, one embodiment of a seating structure includes a backrest member having a cutout formed in a lower region thereof and defining a pad portion coupled to opposite side portions with a pair of connectors laterally spaced on opposite sides of the pad portion. The pad portion is pivotable about the pair of connectors relative to the opposite side portions. A body supporting substrate is disposed along a front of the backrest member and covers the pad portion.

In another aspect, a backrest kit includes a backrest member and a body supporting substrate disposed along a front of the backrest member. An auxiliary support member is disposed between the backrest member and the body supporting substrate. A handle is configured to be coupled to the auxiliary support member and gripped to move the auxiliary support member between and relative to the backrest member and the body supporting substrate. A lock component is configured to be coupled to the auxiliary support member and prevent movement of the auxiliary support member between and relative to the backrest member and the body supporting substrate.

In another aspect, one embodiment of a seating structure includes a backrest member having a front body-facing surface, a central, spine region and side regions positioned on opposite sides of the spine region. The backrest member has a plurality of openings formed in at least one of upper, middle and lower portions of the side regions on opposite sides of the spine region. The spine region has a greater rigidity than the side regions. An auxiliary support member is moveably coupled to the backrest member and is moveable in front of the front body-facing surface of the backrest member. A body supporting substrate is disposed along the front body-facing surface of the backrest member and covers the auxiliary support member.

In another aspect, one embodiment of a seating structure includes a backrest member having a front body-facing surface and an auxiliary support member moveably coupled to the backrest member. The auxiliary support member is vertically moveable in front of the front body-facing surface of the backrest member between first and second vertical positions. The auxiliary support member is moved forwardly relative to the backrest member from a first position to a second position as the auxiliary support member is moved from the first vertical position to the second vertical position. A body supporting substrate is disposed along the front body-facing surface of the backrest member and covers the auxiliary support member.

In another aspect, a seating structure includes a frame and a flexible backrest member coupled to the frame at upper and lower locations of the flexible backrest member. A brace is directly connected to the flexible backrest member at vertically spaced locations positioned vertically between the upper and lower locations. A support member is coupled to the brace and engages a rear of the flexible backrest member.

The various embodiments of the seating structure provide significant advantages over other seating structures. For example and without limitation, the backrest member is provided with a flexible member having a three-dimensional contour that is shaped to hold and support the body of the user. This contour is introduced, in some embodiments, without a peripheral frame and without an intermediate member engaging and forcing a shape change of the flexible member. At the same time, the unique set of saddle shapes created by the geometry of the supporting structure provides a soft initial support to the user, yet provides firm support as the user deflects the backrest rearwardly. The unique structure also provides an improved aesthetic.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 33 is a table with diagrams showing the various band properties for the laterally extending bands shown in FIG. 32.

FIG. 34 is a table with diagrams showing the various band properties for the diagonal/vertical bands shown in FIG. 32.

DETAILED DESCRIPTION OF THE PRESENTLY PREFERRED EMBODIMENTS

Figure 1:
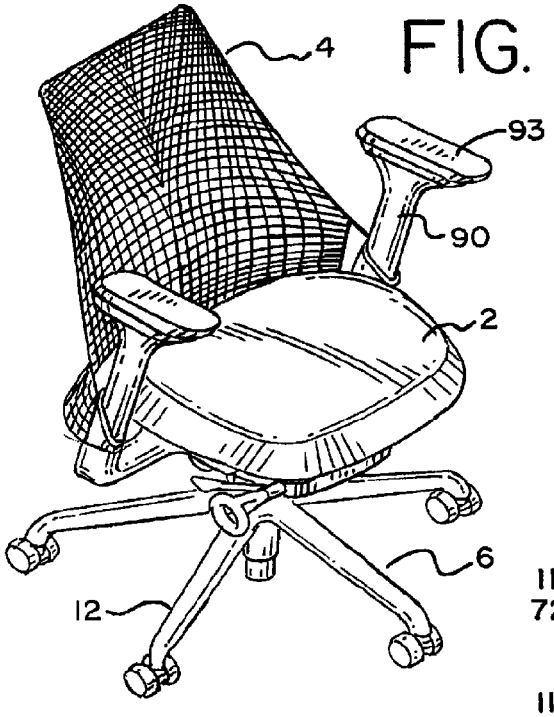
FIG. 1 is a front perspective view of a first embodiment of a seating structure.
Figure 2:
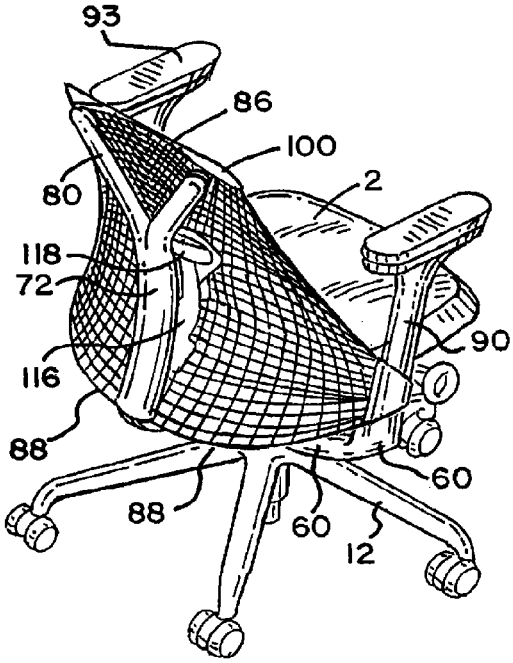
FIG. 2 is a rear perspective view of a first embodiment of a seating structure.
Figure 3:
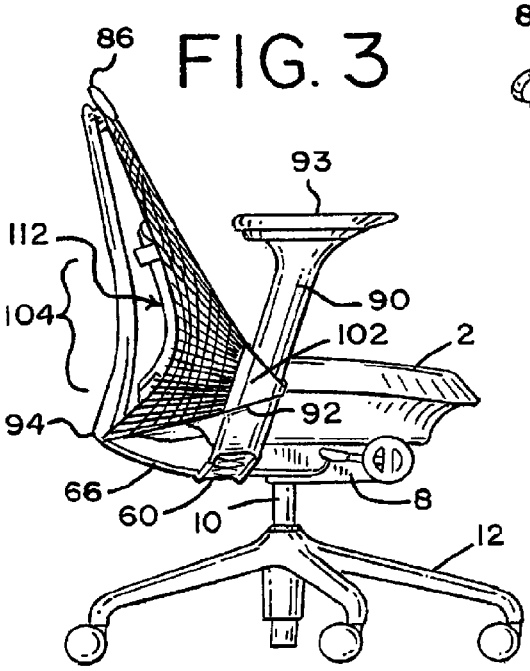
FIG. 3 is a side view of a first embodiment of a seating structure.
Figure 4:
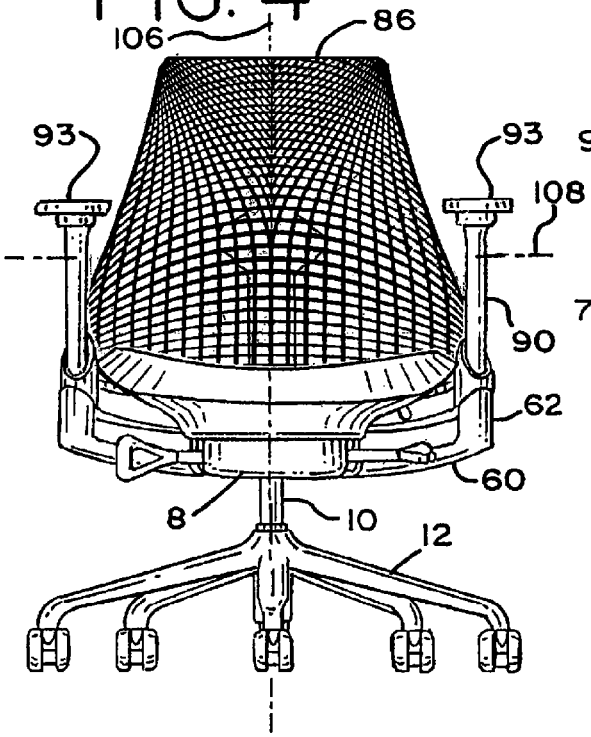
FIG. 4 is a front view of a first embodiment of a seating structure.
Figure 5:
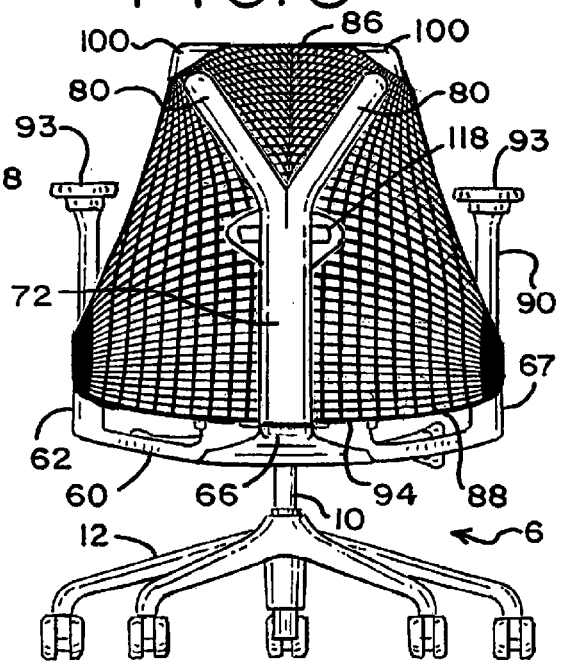
FIG. 5 is a rear view of a first embodiment of a seating structure.
Figure 6:
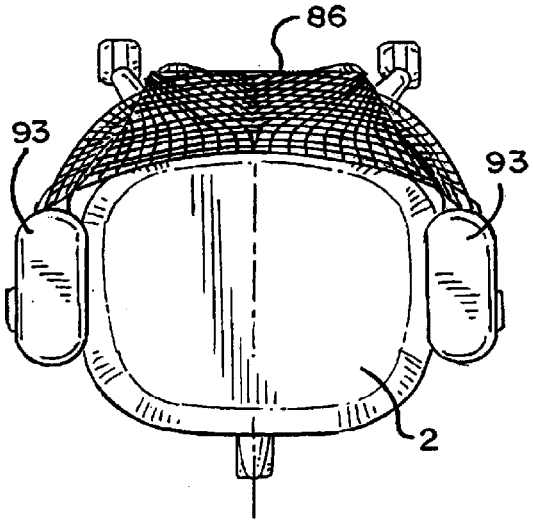
FIG. 6 is a top view of a first embodiment of a seating structure.
Figure 7:
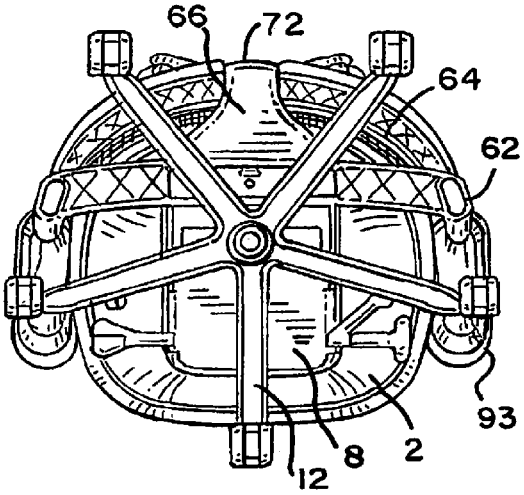
FIG. 7 is a bottom view of a first embodiment of a seating structure.
Figure 8:
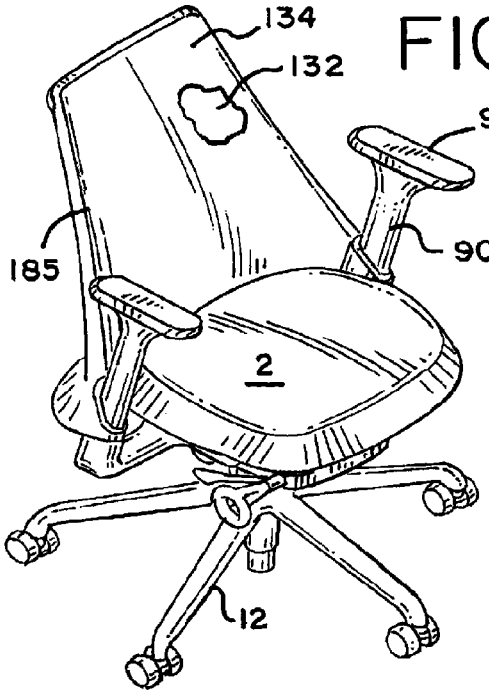
FIG. 8 is a front perspective view of a second embodiment of a seating structure.
Figure 9:
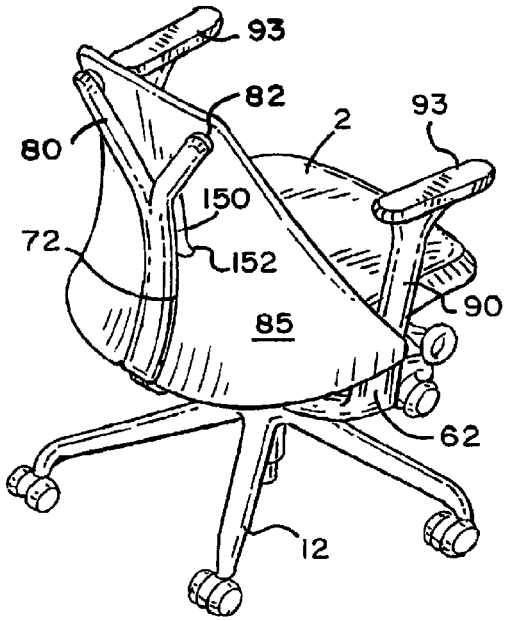
FIG. 9 is a rear perspective view of a second embodiment of a seating structure.
Figure 10:
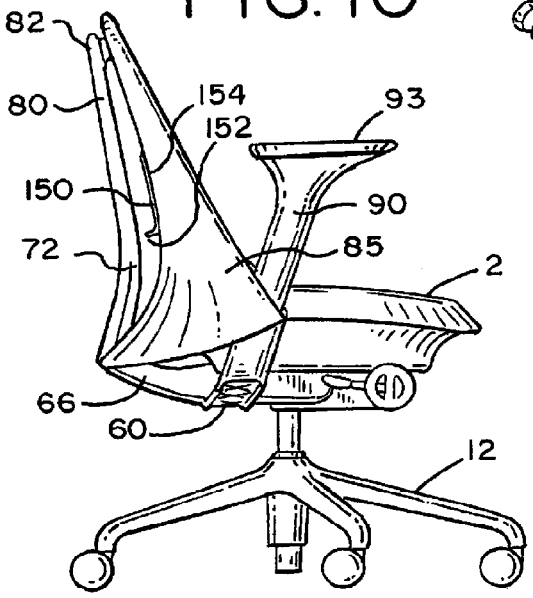
FIG. 10 is a side view of a second embodiment of a seating structure.
Figure 11:
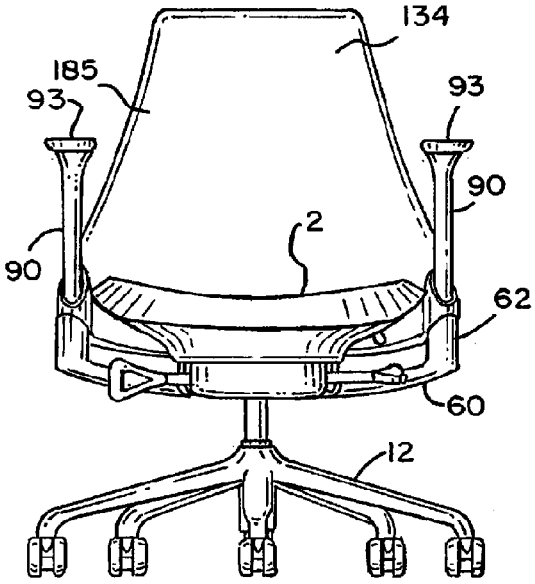
FIG. 11 is a front view of a second embodiment of a seating structure.
Figure 12:
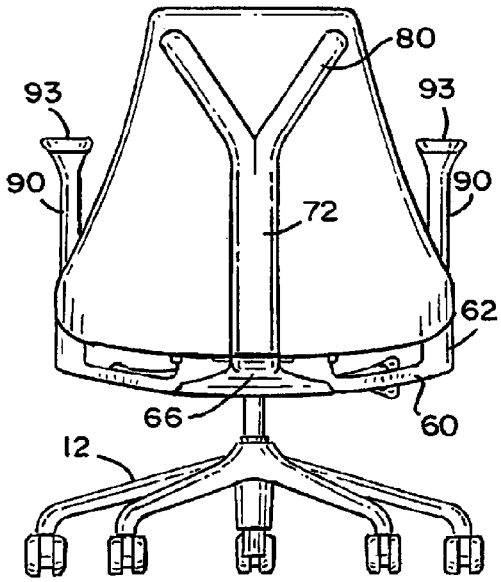
FIG. 12 is a rear view of a second embodiment of a seating structure.
Figure 13:
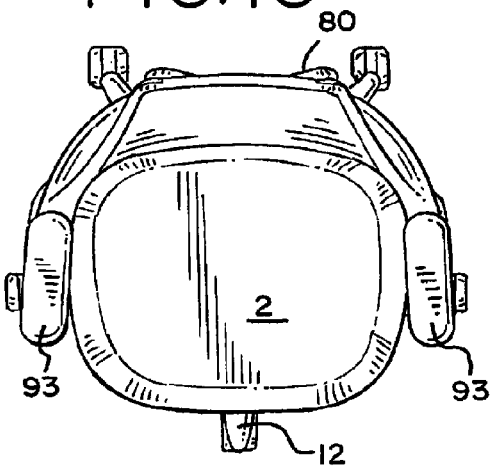
FIG. 13 is a top view of a second embodiment of a seating structure.
Figure 14:
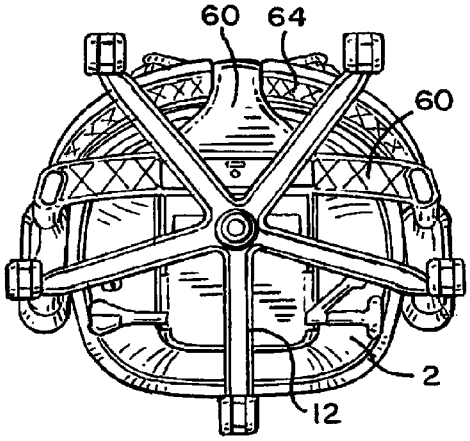
FIG. 14 is a bottom view of a second embodiment of a seating structure.

It should be understood that the term "plurality," as used herein, means two or more. The term "longitudinal," as used herein means of or relating to length or the lengthwise direction, and in general corresponds to a direction running between a front and back or top to bottom, for example from a front of a seat to a back thereof, or from a bottom of a backrest to the top thereof, and vice versa. The term "lateral," as used herein, means situated on, directed toward or running from side to side. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components.

Tilt Control Housing and Seat:

Referring to FIGS. 1-15, a seating structure is shown. The seating structure is configured as a chair, and includes a seat 2, a backrest 4 and a base 6. The base includes a tilt control housing 8, a support column 10 coupled to and supporting the tilt control housing and a base structure 12 coupled to and supporting the support column. The tilt control housing includes a biasing mechanism, such as a leaf spring 14, torsion spring, tension/compression spring, etc., or combinations thereof, that engage and bias a rear tilt bracket 16 to an upright position. The rear tilt bracket 16 is pivotally connected to the tilt control housing 8 at a main pivot 18. The seat 2 is supported by the tilt control housing, and includes a skirt 20, secured to and supporting a seat support 22, for example and without limitation by a plurality of fasteners. The seat support 22 includes a pan 26, with a layer of foam and fabric 24 interfacing with the user. In other embodiments, the seat may be configured with a suspension material.

Figure 15:
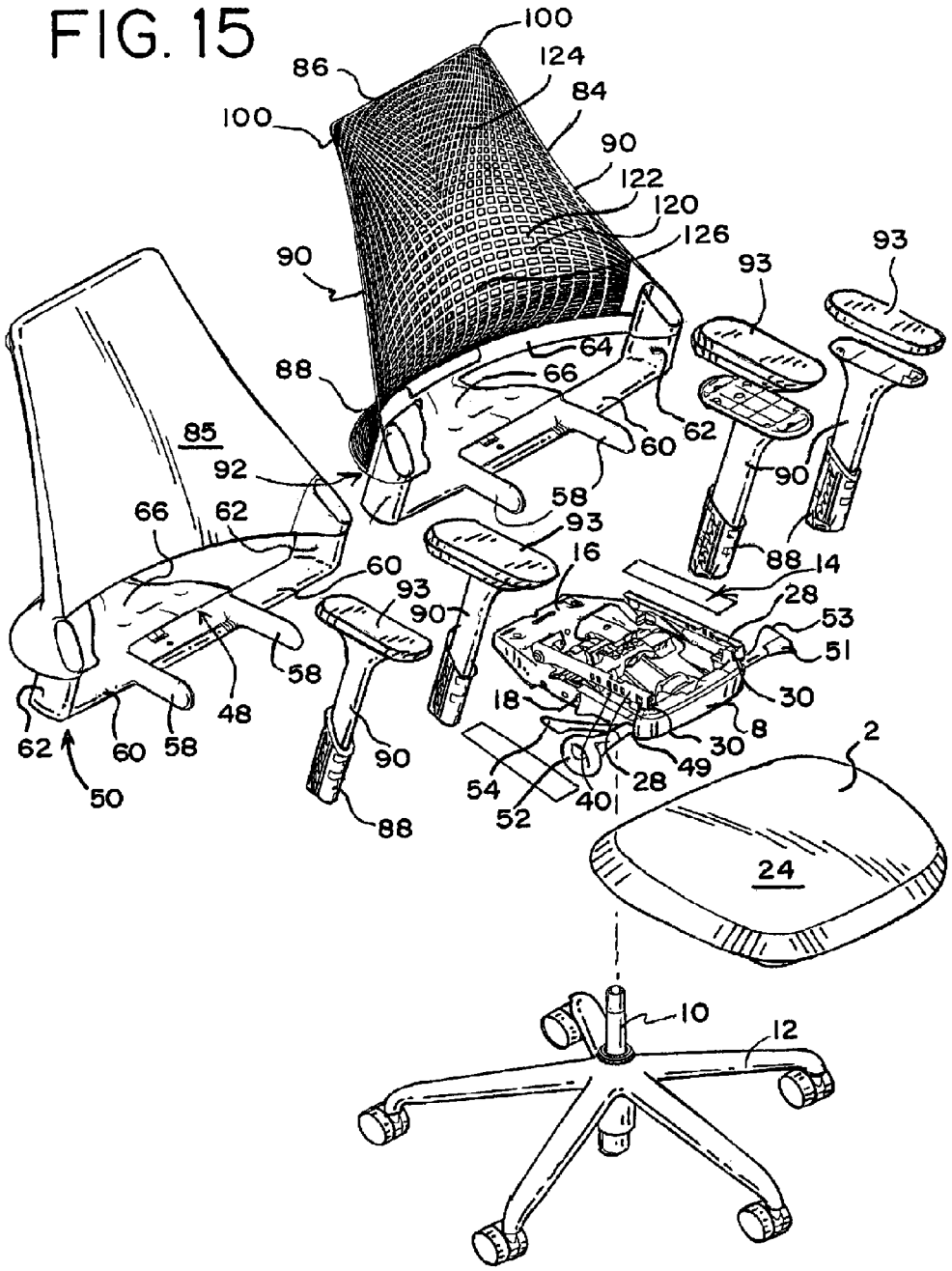
FIG. 15 is an exploded perspective view of various embodiments of a seating structure.
Figures 16, 16A, 16B, 16C, 17:
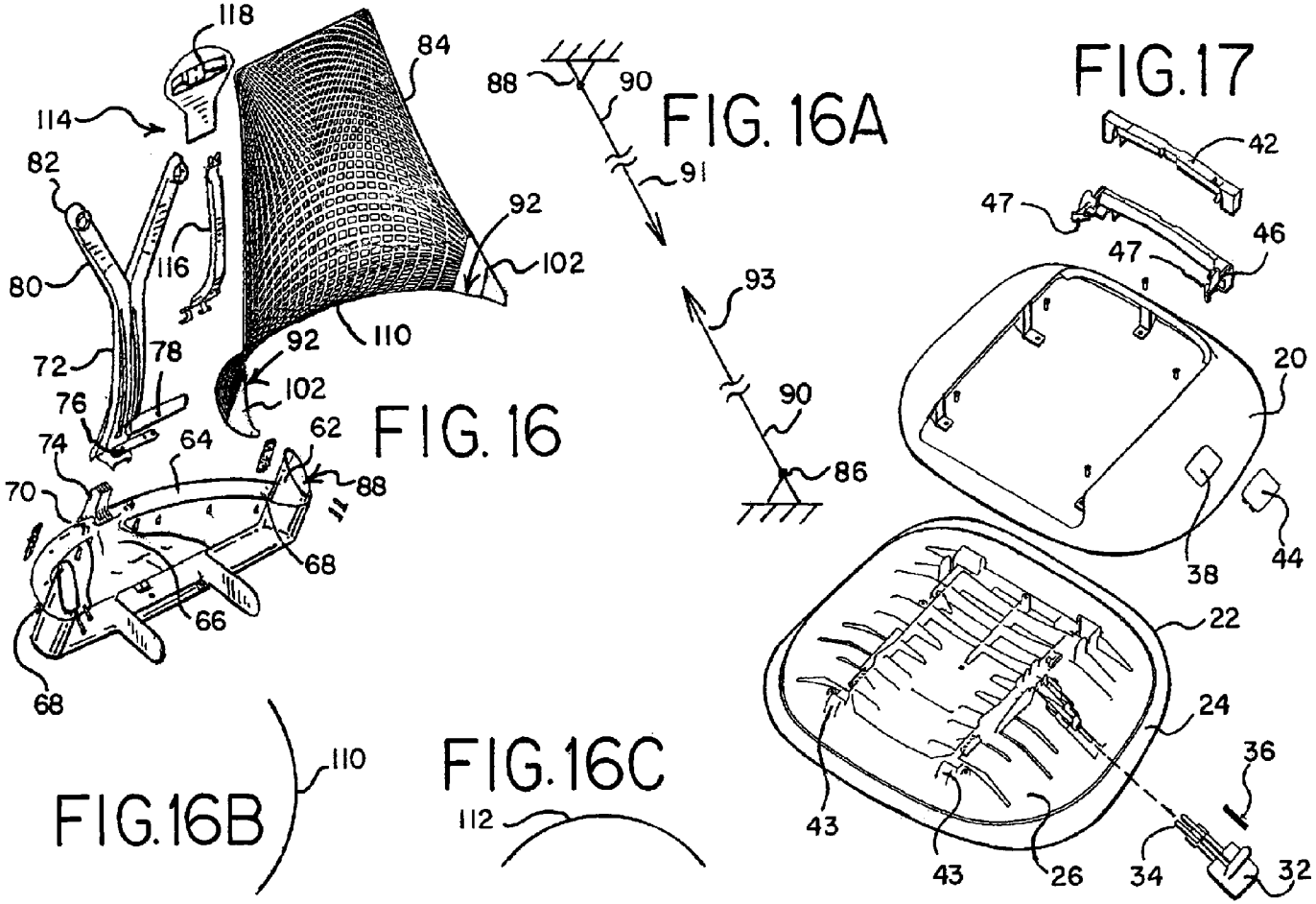
FIG. 16 is an exploded perspective view of one embodiment of a backrest for a seating structure.
FIG. 16A is a schematic diagram of the tension vectors along a side edge of the backrest member.
FIG. 16B is a schematic cross-sectional of a first saddle taken along a vertical plane.
FIG. 16C is a schematic cross-sectional of a second saddle taken along a horizontal plane.
FIG. 17 is a bottom, exploded perspective view of one embodiment of a seat for a seating structure.
Figure 19:
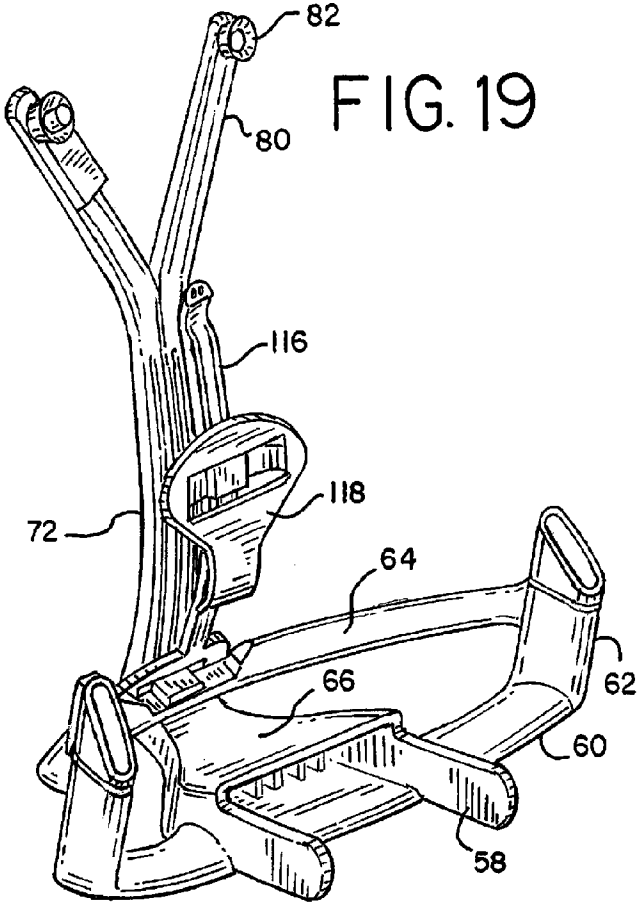
FIG. 19 is a partial perspective view of one embodiment of a backrest structure.
Figure 18:
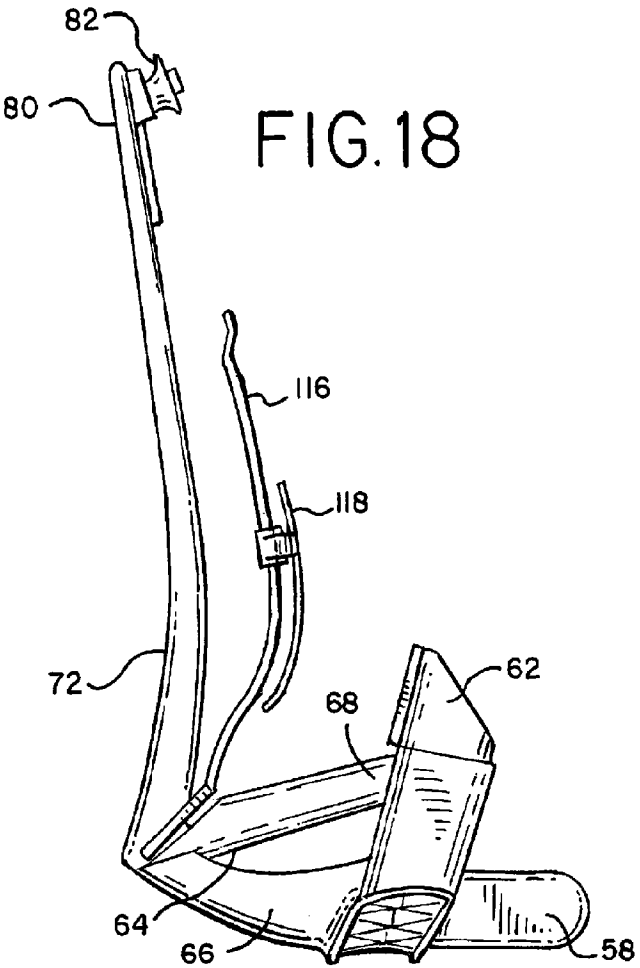
FIG. 18 is a partial side view of one embodiment of a backrest structure.

Referring to FIGS. 15 and 17, the pan 26 slides along a pair of rails 28 pivotally attached to the rear tilt bracket 16 and slidably supported at a front of the housing by a pair of guides 30. An actuator 32, biased laterally by a spring 36, extends through an opening 38 in the skirt and includes end portions 34 that are engaged with openings 40 formed in one of the rails to lock the seat at a desired seat depth position. A stop member 42 may be provided to prevent the seat form travelling too far rearward and coming off of the rails. Stop members 43 limit the forwardmost travel of the seat. The stop member 42 may be installed after the seat is assembled onto the rails. In an alternative, non-adjustable embodiment, the opening in the skirt is closed with a cover 44. A lock member 46 is snapped into position after the seat is assembled on the rails, with a pair of tab features 47 engaging a hole 49 in the rail to prevent the seat from having any forward/rearward movement.

The rear tilt bracket 16 is inserted into a cavity 48 formed in a backrest support 50 and is coupled to the backrest support. The support includes a pair of flanges 58 that extend forwardly and cover the sides of the rear tilt bracket. In operation, the user tilts rearwardly, with the backrest support 50 and rear tilt bracket 16 pivoting about the main pivot 18 in opposition to the biasing force of the springs 14. The seat 2, coupled to the rails 28, pivots with the rails as they rotate and slide relative to the tilt control housing 8. A control 52 is provided to adjust the biasing force of the spring. Likewise, the height of the support column can be changed by operating a control 54. Rear and forward tilt limiter actuators 51, 53 are coaxially aligned with the spring control 52, with the rear limiter positioned rearwardly of the forward limiter.

Figure 25:
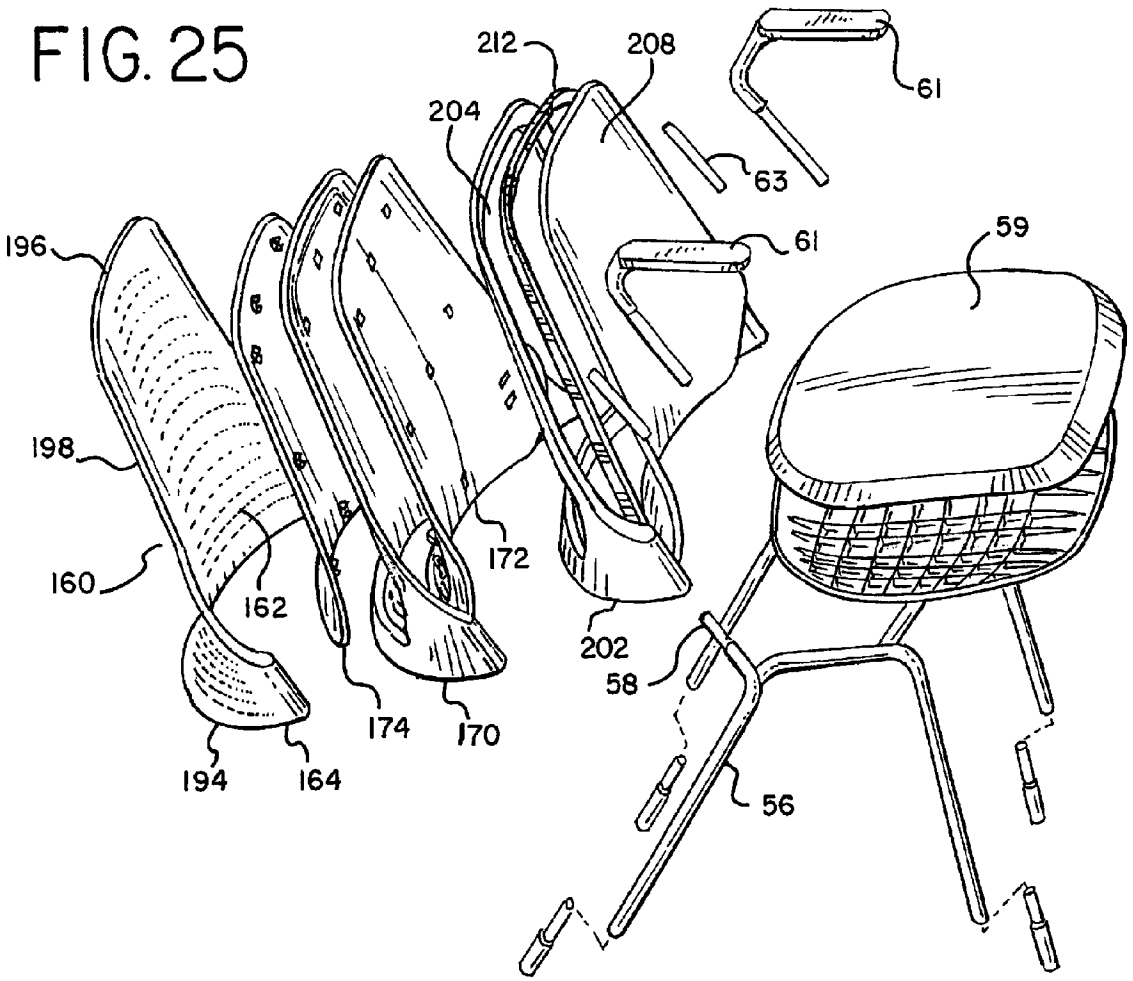
FIG. 25 is a perspective view of alternative backrest configurations.

In another embodiment shown in FIG. 25, the base includes a frame 56 having a pair of posts 58 coupled to the backrest. Further aspects of the seating structure shown in FIG. 25 are disclosed in a U.S. Provisional Application Ser. No. 61/323,654 entitled Chair Construction and Method Therefore and filed the same day as the present application, with the entire disclosure thereof hereby being incorporated herein in its entirety.

Backrest:

The backrest support 50 is configured as a molded plastic component having a cross member 60 terminating in a pair of opposite, laterally spaced side uprights 62 and a curved support 64 connected to the side uprights and a center support 66. The support may be made of various suitable materials, including without limitation glass filled nylon, lass filled polypropylene PBT, Petra, and other similar materials, or combinations thereof. The curved support 64 has a forwardly facing concave contour, with end portions 68 thereof positioned higher than an intermediate portion 70 or middle portion. The backrest support further includes an upright 72 having a central member received on a projection 74 and coupled to the center support 66 and curved member 64. A bracket 76 and cover 78 secures the upright to the curved support 64. The upright has a pair of arms 80 that diverge outwardly and upwardly, with end portions 82 configured as upper mounting portions to support a backrest member 84.

Referring to FIGS. 1-15, a pair of armrests 86 are disposed in cavities 88 formed by the side uprights 62, and are coupled thereto. The armrests include inner sleeve members 88, and a stem disposed 90 in the inner sleeve. An arm support 93 is coupled to the stem. In various embodiments, the armrests are vertically adjustable, by way of the stem moving relative to the inner sleeve and side uprights, and/or horizontally adjustable, with the arm support being laterally, longitudinally and rotationally adjustable. The adjustable armrests are further disclosed in U.S. Provisional application No. 61/323,660 entitled Adjustable Armrest and filed Apr. 13, 2010, with the entire disclosure thereof being hereby incorporated herein in its entirety.

Figure 32:
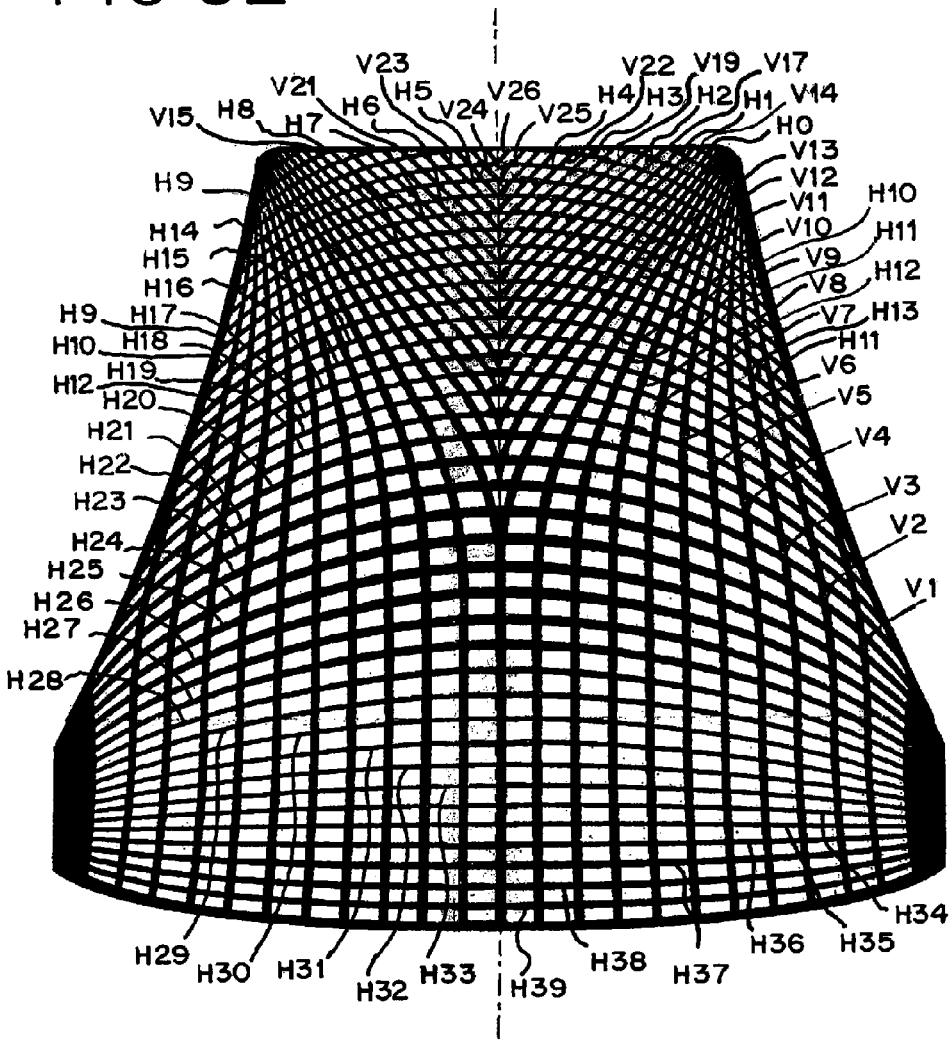
FIG. 32 is a front view of one embodiment of a backrest member showing various bands.

The backrest member 84 may be configured in many different arrangements and materials. In a first embodiment, shown in FIGS. 1-7 and 15, the backrest member is made of a flexible elastomeric material. For example and without limitation, the backrest member may be made of TPU Huntsman Irogran A92P4637R, an aromatic urethane, which may be selected for its toughness, elastic modulus, UV resistance, economy, and smooth, non-tacky tactile feel. Other suitable materials may include without limitation aliphatic urethanes, TPE such as Hytrel or PEBA materials, or combinations thereof. The backrest member may be made translucent. The backrest member has a thickness of from about 3 mm to about 9 mm, with a nominal thickness of about 4 mm in one embodiment. Referring to FIGS. 32-34, the height and thickness of a strand or band of material may vary, for example inversely such that the strand may be appear to be thinner at the laterally aspects of the backrest, yet have approximately the same cross-section area. In various embodiments, any of the laterally or vertically/diagonally extending bands may vary in cross sectional area to create zones of higher stiffness. Referring to FIGS. 32 and 33, lateral bands H0-H39 are sequentially called out from the upper, outer corners to the bottom of the backrest, with various cross-sectional shapes and areas shown. Likewise, diagonal/vertical bands V1-V26 are sequentially called out from an outermost lateral position (V1) moving inwardly, with a pair of V11 strands converging to form a single band along a centerline position at the bottom portion of the backrest member. Bands V12-V26 also converge at intersecting laterally bands as shown. The band or strand may be thickened in areas in which increased support (stiffness) is desired. For example, supporting the user at the core (near the centerline of the back) may be desirable, thus 'islands' of thicker strands or bands may be utilized to give increased support in the sacral, lumbar, and thoracic areas along the centerline of the backrest. The increased thickness area may be a stripe whose width is on the scale of the human spine, 60 mm wide more or less. This will increase the bending stiffness in that area, as well as the spring rate of a strand when the backrest is supporting the user by catenary forces. In various embodiments, the backrest member may be molded with a three-dimensional shape even when free of any tension or constraints, or may be molded or formed as a flat member, with the three-dimensional shape being introduced by way of the tension and connections to the support structure.

The elastomeric material may be oriented, for example by compression or stretching, to provide the backrest member with different load bearing characteristics in different directions. Various oriented elastomeric materials and methods of making components from such materials are disclosed in U.S. Publication 2006, 0267258A1, published Nov. 30, 2006, and U.S. Publication 2006/0286359 A1, published Dec. 21, 2006, the entire disclosures of which are hereby incorporated herein by reference. The backrest member may alternatively be made of a fabric, or of an elastomeric membrane, for example as a woven membrane as disclosed in U.S. Pat. No. 6,059,368, the entire disclosure of which is hereby incorporated herein by reference. In one embodiment, a plastic (elastomeric) carrier may be molded or otherwise secured to the edge of the fabric to maintain the proper tension and provide for the required compliance to fit the end user.

In one embodiment, the backrest member 84 has an upper portion with an upper edge 86, opposite side edges 90 and a lower portion with a lower edge 88. The upper edge 86 is shorter than the lower edge 88. The lower edge 88 has end portions 92 that are positioned forwardly of the upper edge 86, with the side edges 90 extending downwardly and forwardly from the upper edge 86 to the lower edge 88. The lower edge 88 has a forwardly facing concave shape, which mates with the curved support 64. An intermediate or middle portion 94 of the lower edge is positioned reardwardly of the upper edge 86, and beneath an upper support surface of the seat 2 and behind a rear portion of the seat 2. In this way, and due to the curvature, length and positioning of the lower edge 86, the lower edge has end portions 92 positioned in front of the upper edge 86 and an intermediate or middle portion 94 positioned rearwardly of the upper edge 86 when the backrest is in a normal, upright position. It should be understood that the intermediate portion includes portions of the backrest member on opposite sides of the upright 72. The end portions 92 are laterally spaced such that various targeted populations may be seated with their hips located therebetween. Likewise, the backrest member has a height sufficient so as to extend above the target populations' scapula. In one embodiment, the angle of the upper back in an upright, at-rest position is about 103 degrees relative to horizontal.

The curved support 64, with its intermediate portion and outer side portions, defines a lower support member for the backrest member. As shown in FIGS. 2, 5, 30 and 31, the end portions 82 defining the upper mounting portions in one embodiment are configured as flange members that are received in pockets 98 formed at upper, outer corners 100 of the backrest member 84. In other embodiments, shown for example in FIG. 16, the end portions 82 are coupled to the backrest member with a pivot member. The lower edge 88 is secured to the curved support along a length thereof, except at a centerline thereof, wherein an opening is formed that allows the upright 72 to pass through. Of course, in one embodiment, the lower edge 88 may also be secured along the centerline to the upright. The lower edge may be connected to the support in various ways. In one embodiment, the vertically extending strands, or bands, have eyelets molded therein, with the eyelets fitting over and engaging posts protruding downwardly from the bottom of the lower face of the support 64. In other embodiments, the lower edge is connected to the curved member with fasteners, welding, bonding, carrier members, and the like, and/or combinations thereof. In one embodiment, the side uprights 62 also form part of the side mounting portion in combination with the ends 68 of the curved support 64. It should be understood that the side uprights 62 may be omitted in one embodiment, with the curved member 64 acting alone as the lower support member. As shown, the backrest member 84 includes a mounting portion 102 formed at the junction of the side 90 and lower edges 88, with the mounting portions 102 secured to the side uprights 62. In one embodiment, the mounting portions 102 form a continuous loop that slides over the side uprights 62. A pair of screws may be installed through the backside of the upright and the loop and into a threaded plate, thereby sandwiching and fixing the mounting portions 102 against the uprights 62.

The backrest member 84 is put in tension between the upper and lower mounting structures 82, 64, 62. The tension may be different depending on the location and orientation on the backrest member. In general, the horizontal strands or bands carry more tension than the vertical strands in the lumbar region. Above the mounting portions 102, the horizontal and vertical strand tension is in the same range. After installation, the tension ranges from less than 5 lbs at the bottom edge 88 to up to 80 lbs proximate the upper end portions 100. In particular, the backrest member 84 is put in tension along the upper edge portion 86 between the end portions 100. The backrest member is further tensioned along the side edges 90, with a tension vector 91 directed away from the upper edge portion 86 and toward the lower edge portion 88, and taken along any point of the side edge 90, having a forwardly and downwardly extending directional component. Of course, the opposite is also true, a tension vector 93 directed away from the lower edge portion 88 and toward the upper edge portion 86 will have a rearwardly and upwardly extending directional component, as shown in FIG. 16A, with the vectors 91 and 93 being equal and opposite. The backrest member 84 is further tensioned laterally from side-to-side in the lumbar region 104, and diagonally from the end portions 100 of the upper edge 86 to opposite end portions 92 of the lower edge 88. The flexible member has a forwardly facing convex shape formed along a vertical centerline 106 thereof between the upper and lower edges 86, 88, and a forwardly facing concave shape taken along a horizontal plane 108 in the lumbar region 104 thereof. In this way, the backrest member has unique saddle shapes, one saddle 110 defined by the front thereof extending laterally along the lumbar region, and one saddle 112 defined by the rear thereof extending longitudinally along the lumbar region. Cross-sections of the saddles are shown in FIGS. 16B and C. In this way, the backrest provides a soft initial support to the user, yet provides firm support as the user deflects the backrest rearwardly. The unique structure also provides an improved aesthetic, while eliminating the need for additional supports in the lumbar region.

In one embodiment, the backrest member is supported by the support structure at at least one upper location and at at least three lower locations, including a pair of laterally spaced side locations positioned forwardly of the upper location and at least one intermediate location positioned rearwardly of the side locations. In one embodiment, the intermediate location is defined by a plurality of locations positioned along a curve extending between the side locations.

If additional support is desired, an auxiliary lumbar support 114 may be provided, as shown in FIGS. 1-16, 18, 19 and 35-38. In this embodiment, a brace 116 is secured to the backrest member 84, for example with fasteners, tabs, adhesive and the like, or combinations thereof. For example, in one embodiment, the brace 116 has a curved or bow shape which matches the contour of the adjacent backrest member. The brace may have a pair forwardly extending lugs 300, 302 positioned at each end thereof. In one embodiment, each lug is configured with a pair openings 304, or alternatively a single opening, which defines a lip or catch portion 306 on opposite sides of the opening(s). The lug 300, 302 engages a middle strand (converged V11) or band of the backrest member, for example with a middle portion of the lug positioned between the openings 304. A clip 308, 310, fashioned in one embodiment with a U-shape, has a pair of resilient arms 312, each configured with a catch member 314. The clip 308, 310 is disposed over the center band, which may have an undercut 316 such that the clip lies flush with a front surface of the bands, with the arms 312 being received through the openings 304 until the catch members 314 engage the catch portions 306 on the lugs, thereby securing the brace 116 to the backrest member 84.

A pad member 118 is disposed on, and slides vertically along the brace to a desired vertical position, wherein it engages the rear surface of the backrest member 84. Since the brace 116 is secured to the backrest member, rather than to the upright, the brace 116 and pad 118 are allowed to flex and move with the backrest member 84, thereby providing additional support but without restricting the movement of the backrest member. In an alternative embodiment, the pad member 118 can be coupled directly to, and moveable along, the upright 72.

Figure 36:
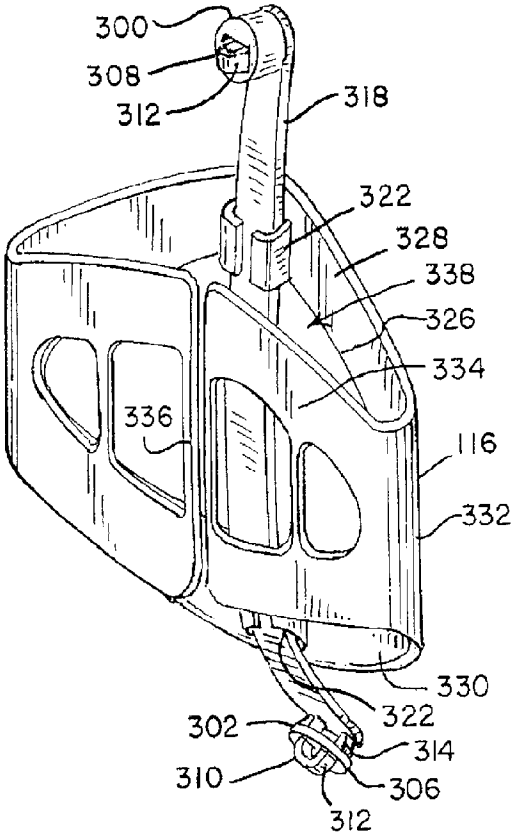
FIG. 36 is a front perspective view of a lumbar support.
Figure 35:
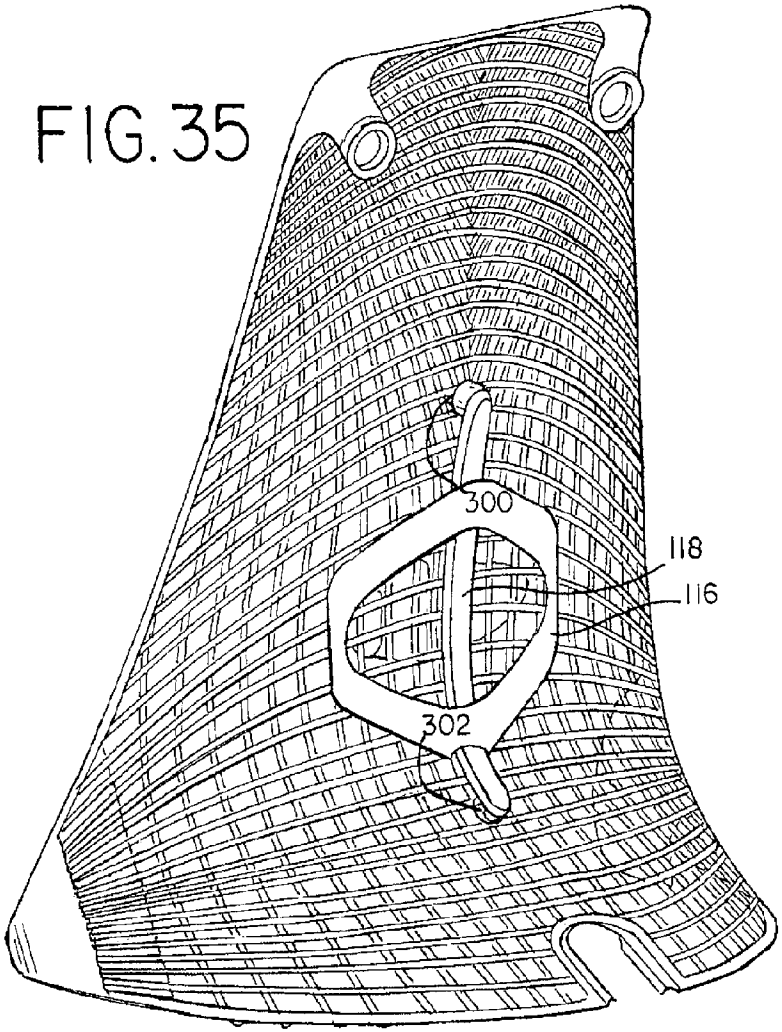
FIG. 35 is a rear perspective view of one embodiment of a backrest configured with a lumbar support.
Figure 37:
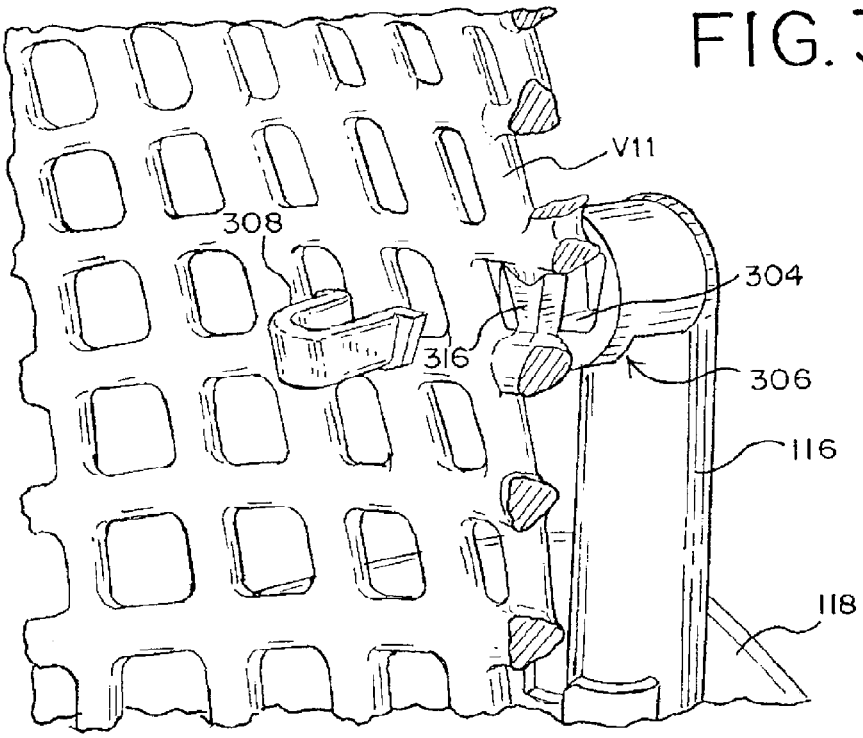
FIG. 37 is an enlarged view of the upper attachment location for the lumbar support shown in FIG. 35.
Figure 38:
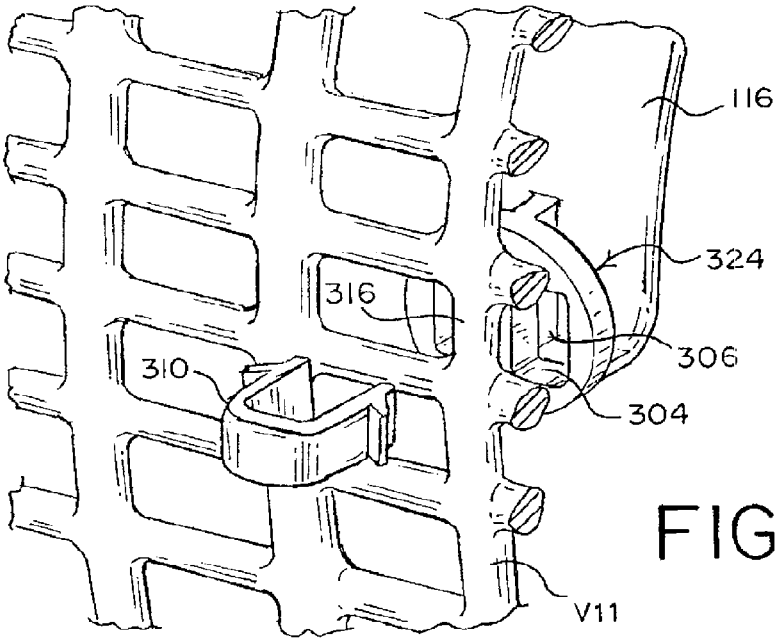
FIG. 38 is an enlarged view of the lower attachment location for the lumbar support shown in FIG. 35.

As shown in FIGS. 35 and 36, one embodiment of the pad is configured with pairs of upper and lower clips 322 that can be slid onto the brace from a bottom thereof, with the bottom lug having undercut portions 324 to provide for the insertion of the brace through the clips. The pad further includes a pair of wings 326 that extend laterally outwardly from the brace in a cantilevered configuration. The wings are configured with top, bottom and opposite side portions 328, 330, 332 defining a central opening 338. A pair of front flaps 334 extends laterally inwardly from opposite side edges of the wings, which edges form a living hinge 332, and are each terminated at a free edge 336, such that the front flaps are each cantilevered inwardly. In an alternative embodiment, the front flaps may be joined at the midline, such that a unitary front support is provided. In operation, a front surface of the front flaps 334 engages a rear surface of the backrest member 84. The wings and front flaps are configured such that the front flaps 334 are biased or deflected rearwardly by the backrest member to a loaded position. In this way, the pad, or auxiliary support, provides additional support, for example at the lumbar region. The pad may be moved vertically along the brace to a desired support position.

The backrest member 84 is provided with a plurality of openings 120 that are arranged so as form at least one band 122 of material extending laterally between the opposite sides edges and at least one band 124 extending diagonally from the upper edge portion 86, and in particular from the corners 100 thereof. The diagonal bands 124 extend inwardly and intersect with the laterally extending bands 122 and converge with vertically oriented bands 126 so as to provide a load path for the tension loads. Other secondary bands may be provided to interconnect and maintain the position of the load carrying bands.

Referring to the embodiment of FIGS. 8-14 and 20-24, the backrest member 85 is configured as a more rigid shell 130, which is covered with a foam layer 132 and an outer fabric layer 134. Suitable materials include polypropylene and polyurethane foam, for example 1.5 mm. The fabric may be any such material suitable for seating upholstery. Other layers may be provided to provide flame retardant properties. A bottom edge portion 136 of the shell is coupled to the curved member, with the upper portion 138 of the shell connected to the end portions 82 of the arms 80. In one embodiment, fasteners are driven upward through the lower support 64 into a bottom of the shell, which has a recess shaped to receive a portion of the lower support. Fasteners coupled the end portions 82 to the shell. The shell is configured with a pair of recesses 140 on the front side thereof, and a longitudinally extending slot 142. Referring to FIGS. 20, 21, 23, 24 and 39-40, a cutout 350 is formed in the shell in a lower region thereof so as to define a pad portion 354 connected to opposite side portions with a pair of connectors 352. In one embodiment, the connectors 352, which are integrally formed with the pad and the rest of the shell, are the only connection for the pad. In one embodiment the pad is substantially rectangular shape. In operation, the pad may rotate or pivot about an axis defined by the connectors. The pad also has a vertical slit 151 formed therein.

Referring to FIGS. 20-22 and 39-42, an auxiliary lumbar support 144 has a center portion 154 and opposite side portions 146 connected to the center portion with connectors, with the side portions disposed in the recesses, with an upper guide portion 148 engaging and sliding along the slot, and with a lower guide portion 149 engaging and sliding along a slit 151 formed in the shell. The guide portion 148 engages a stop member on the shell when the auxiliary support is at an uppermost support position. A handle 150 having a grippable portion 152 is connected to the upper guide portion 148 and extends through a slit 154 in the foam and/or fabric covering the back of the shell, with the handle 150 and grippable portion 152 exposed to the user. The handle may include a pair of resilient arms 360, each having a catch portion 362, which are inserted through and engage corresponding catch portions 364 on the guide portion of the auxiliary support. A stop portion 366 of the handle engages a corresponding stop portion 368 on the auxiliary support such the handle is secured in place.

Figure 21:
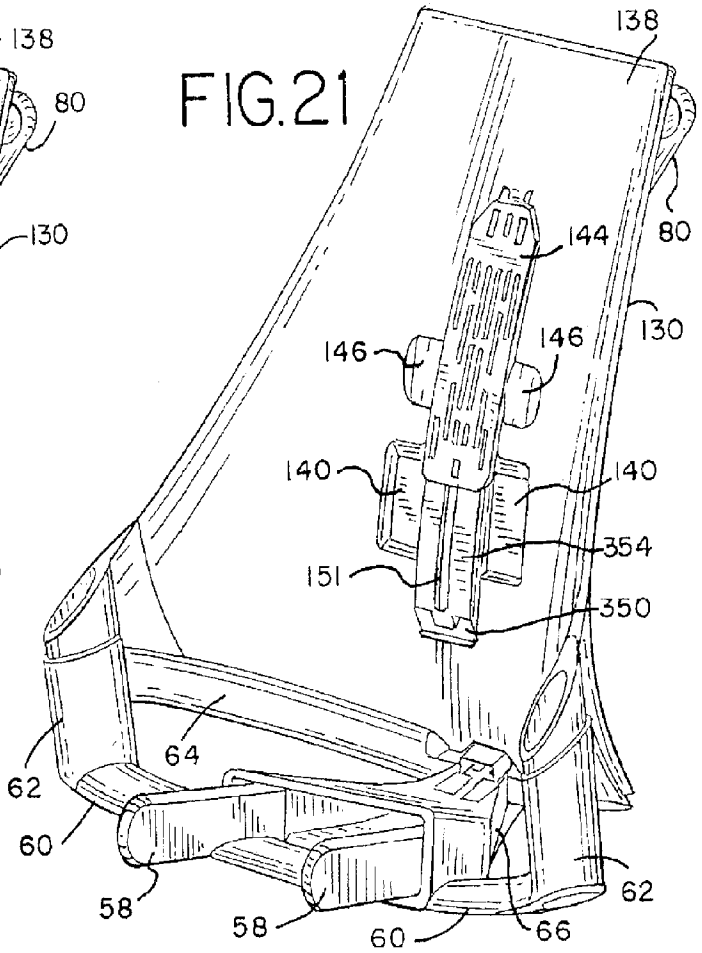
FIG. 21 a partial, front perspective view of another embodiment of a backrest structure with a lumbar support positioned in a non-supporting position.
Figure 20:
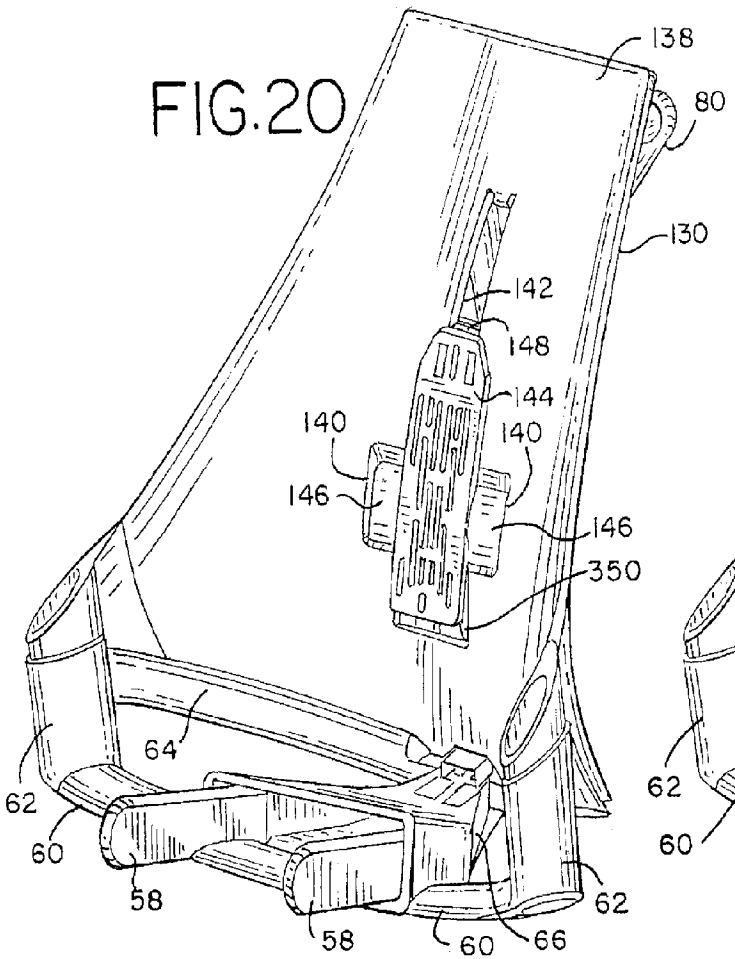
FIG. 20 is a partial, front perspective view of another embodiment of a backrest structure with a lumbar support positioned in a non-supporting position.
Figure 23:
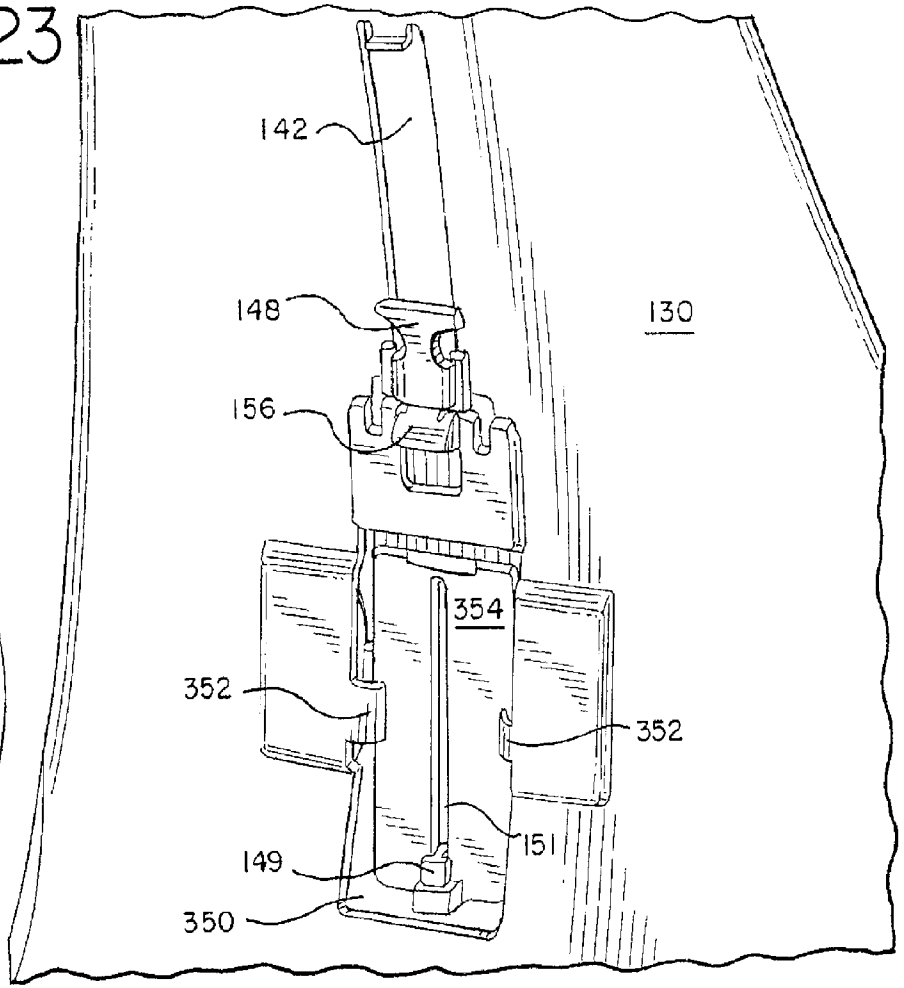
FIG. 23 is a partial, rear view of a lumbar support in a disabled position.
Figure 22:
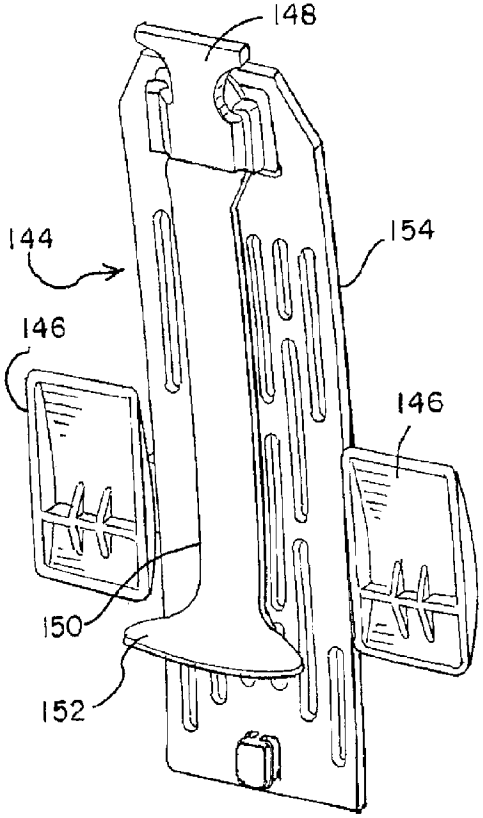
FIG. 22 is a perspective view of a lumbar support pad.
Figure 24:
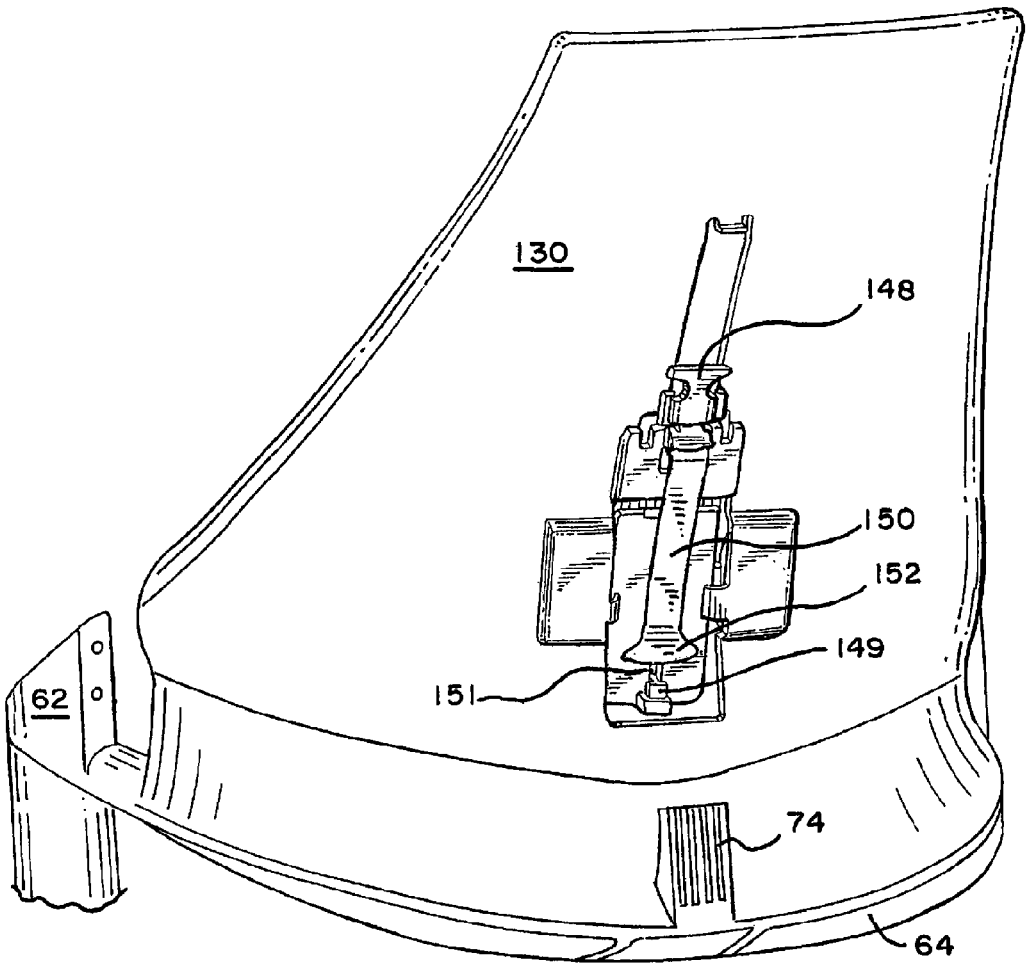
FIG. 24 is a partial, rear perspective view of a backrest with a lumbar support.
Figure 39:
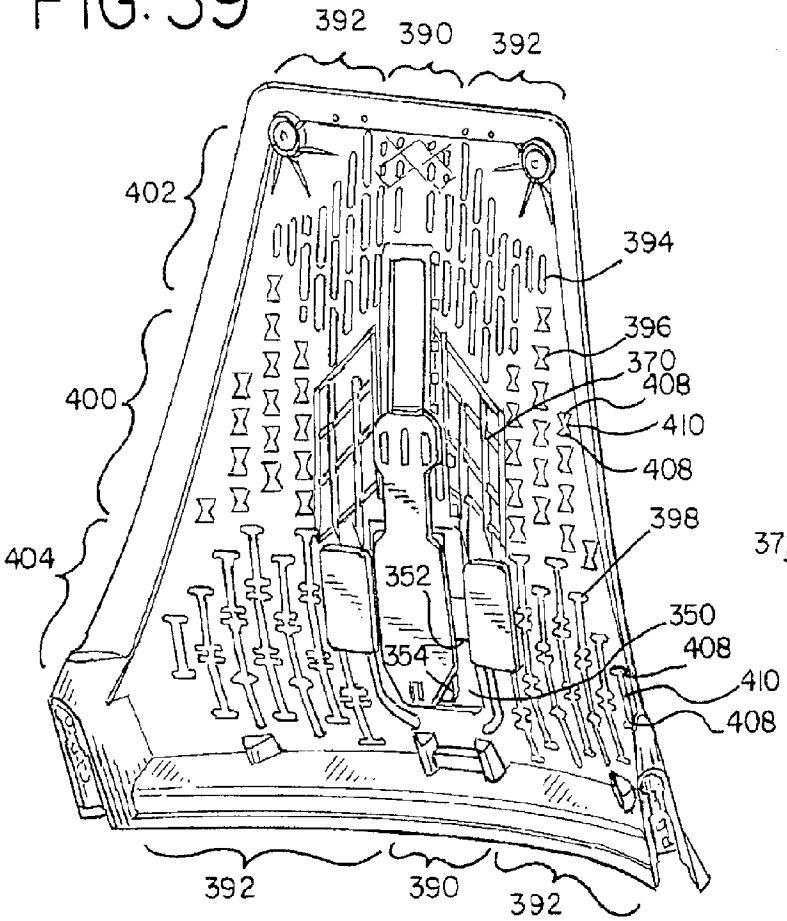
FIG. 39 is a front perspective view of an alternative embodiment of a backrest.
Figure 43:
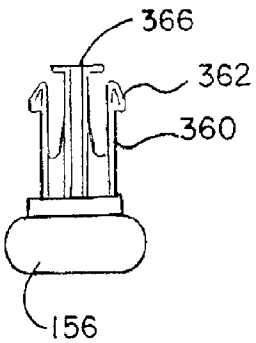
FIG. 43 is a rear view of a lock component.

In operation, the lumbar support 144 is moveable between a supporting position and a non-supporting position as shown in FIGS. 20 and 21 respectively, with the lumbar support being infinitely adjustable between the non-supporting position and an uppermost supporting position. In the non-supporting position, the pads 146 of the lumbar support are disposed in the recesses 140, such that the lumbar support in combination with the front surface of the shell are substantially flush. Alternatively, as shown in FIG. 39, the pads are relatively thin and do not provide any forward support when in the non-supporting position. If more support is desired, the user grasps the handle 150, 152 and moves the lumbar support 144 upwardly, with the pads 146 riding up ramps and along the front surface of the shell between the shell and the body supporting substrate, e.g., foam, thereby biasing the foam 132 and fabric 134 forwardly as shown in FIG. 21. As shown in FIG. 39, ribs 370 are formed on a front surface of the backrest member, and define the ramps. In addition, the back side of the pad may be configured with ribs 372 that are disposed in slots 374 formed in the backrest member when the auxiliary support is in a lowermost position, with the ribs engaging the front of the backrest member and acting as a ramp when the auxiliary support member is moved upwardly, thereby biasing the support member, and overlying body supporting substrate, forwardly. The body supporting substrate may be a cushion, for example and without limitation made of foam, or may be some other material. The foam may be molded in place over the auxiliary support and backrest member, or molded as a separate piece and then attached over the auxiliary support to the backrest member. One or more additional layers, such as a decorative fabric, may overlie the body supporting substrate. Of course, it should be understood that other layers may also be disposed between the body supporting substrate and the underlying auxiliary support member and/or backrest member.

Figure 40:
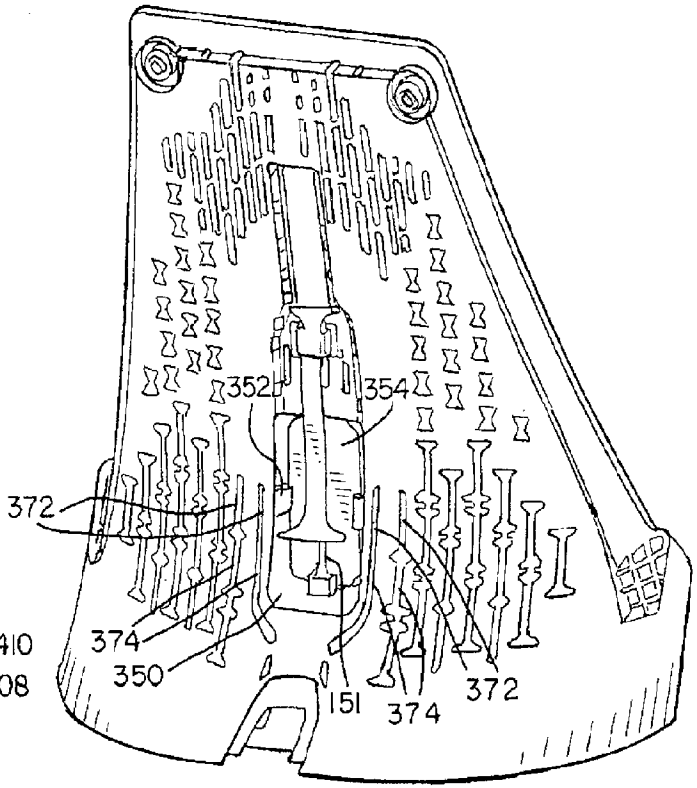
FIG. 40 is a rear perspective view of the backrest shown in FIG. 39.
Figure 42:
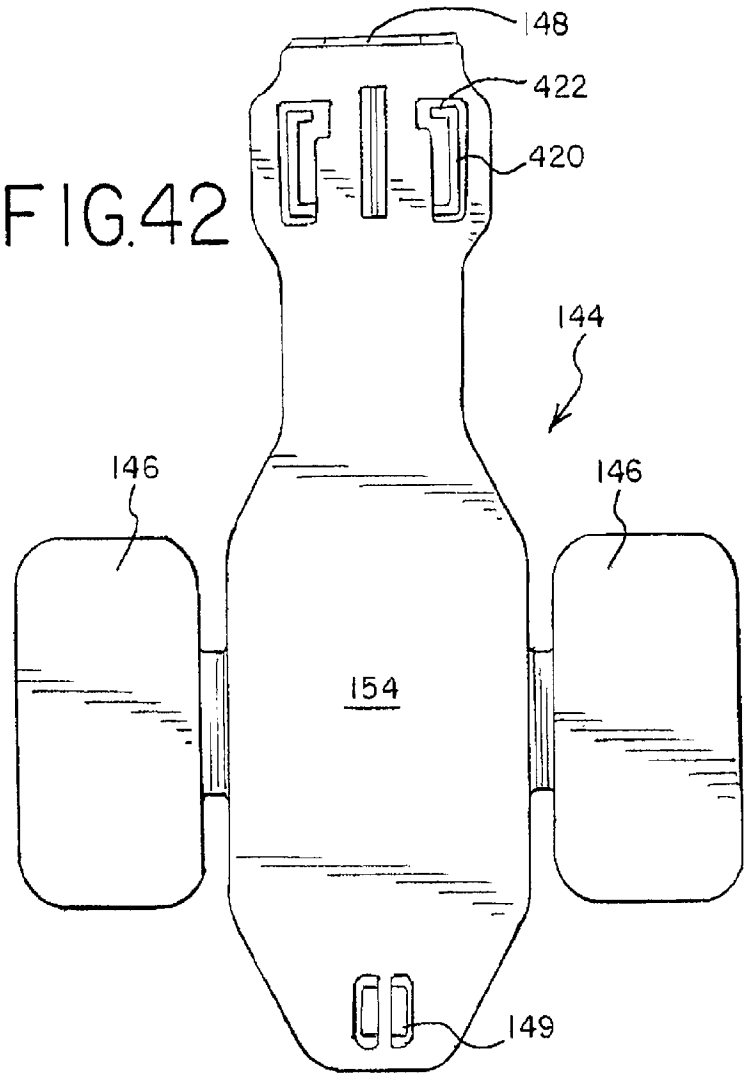
FIG. 42 is a front view of the lumbar support.
Figure 41:
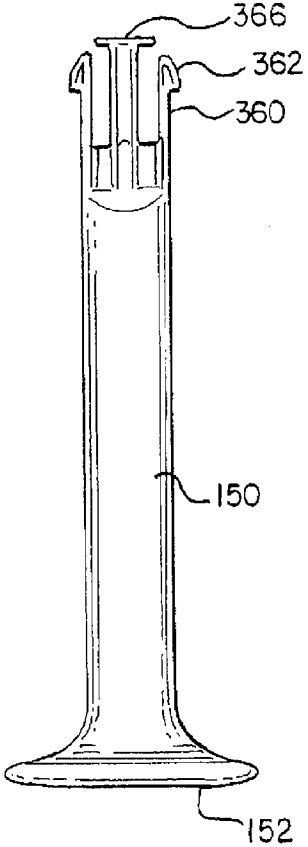
FIG. 41 is a rear view of a handle used to adjust the lumbar support shown in FIGS. 39 and 40.
Figure 45:
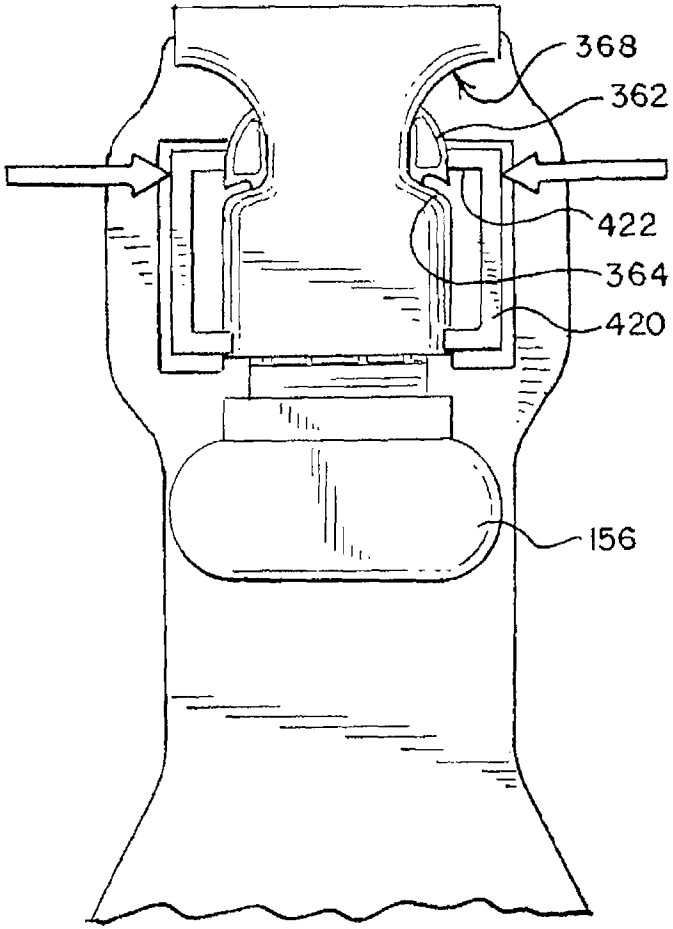
FIG. 45 is a rear view of the lock component, guide and lumbar support.
Figure 44:
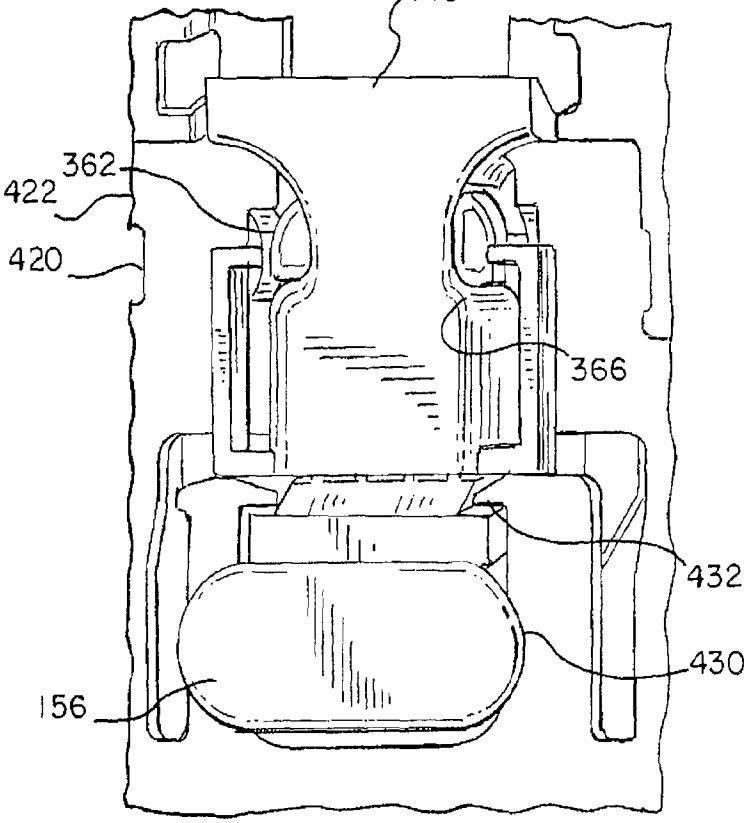
FIG. 44 is a partial, enlarged view of the lock component of FIG. 43 engaged with the lumbar support and backrest shell.

Referring to the embodiment of FIGS. 39 and 40, the backrest member has a central, spine region 390 and side regions 392 positioned on opposite sides of the central spine region. A plurality of openings 394, 396, 398 are formed in the backrest member to provide different degrees of stiffness or rigidity thereto. The stiffness and rigidity may also be modified by varying the thickness or geometry of the material, for example by providing ribs or other bending resistant structural features. The spine region 390, including the auxiliary support member, is relatively stiff so as to provide support to the spine of the user, and provides greater rigidity than side regions 392 positioned on opposite sides of the spine region. A middle portion 400 of the side regions 392, excluding the edge of the backrest member, may be 2 to 3 times less rigid than the central spine region 390, as measured for example by indentation force deflection measurements. Upper and lower portions 402, 404 of the side regions 392 may be less rigid than the middle portions 400 of the side regions 392, for example and without limitation, three times less rigid. In one embodiment, the plurality of openings 396, 398 in the lower and middle portions 400, 404 are configured with vertically spaced laterally extending portions 408 connected with a thinner longitudinal portion 410. In one embodiment, the openings 398 in the lower portion include at least a portion having an I-beam shape, while the openings 396 in the middle portion have an hour-glass or dog-bone shape. In one embodiment, the openings in the upper portion are formed as vertical slits, which may vary in length. The openings in all three portions may be vertically aligned, with columns thereof being horizontally spaced In order to simplify assembly and reduce inventory, a lock component 156 may be installed in place of the handle as shown in FIGS. 23 and 43-45. The lock component 156 includes a shoulder or catch portion 430 that is engaged by a catch member 432 on the shell, and further engages the guide 148 of the auxiliary lumbar support, thereby preventing the lumbar support from moving from the non-supporting position. The foam and fabric are then applied, with the backrest thereby being configured without an adjustable lumbar support. The lock component may include a pair of arms 360, each having a catch portion 362 that engages the catch portions, configured in one embodiment as shoulders, formed on the auxiliary support, and a stop member 366. As shown in FIGS. 42, 44 and 45, the auxiliary support may further include a pair of resilient release arms 420 or prongs each having an end portion 422 aligned with the arms of the lock component or handle. In operation, the user pushes on the arms 420, which bias the arms 360 of the lock member or handle inwardly until the catch portions 362, 364 are disengaged. The lock member and/or handle may then be removed and replaced, for example if it is desired to make the lumbar adjustable by installing a handle or to replace a broken or worn handle. During assembly, the operator may be provided with a kit, which includes the backrest member, a lock component and a handle, with one of the lock component and handle being selected and installed depending on the desired final configuration of the seating structure.

Referring to FIG. 25, other embodiments of the backrest member are shown. In one embodiment, the backrest member 160 is simply made of a rigid plastic material, for example and without limitation polypropylene, but with a shape similar to that shown in the other embodiments, namely a curved lower edge 194 longer than an upper edge 196, with a middle portion of the curved edge positioned below ends thereof, forwardly and downwardly extending side edges 198, a forwardly facing concave shape taken along a vertical centerline, and a forwardly facing convex shape extending laterally in the lumbar region. The backrest member 160 may have openings 162 formed therethrough to provide air circulation and improved aesthetics. A mounting portion 164 at the junction of the side and bottom edges is the sole mounting portion, such that the curved support and upper supports may be eliminated. Of course, such structures may be used in other embodiments. The mounting portion engages the frame post 58. Armrests 61 or plugs 64 may be inserted into the posts 58 to complete the assembly. A seat 59 may be supported by the frame 56.

Figure 27:
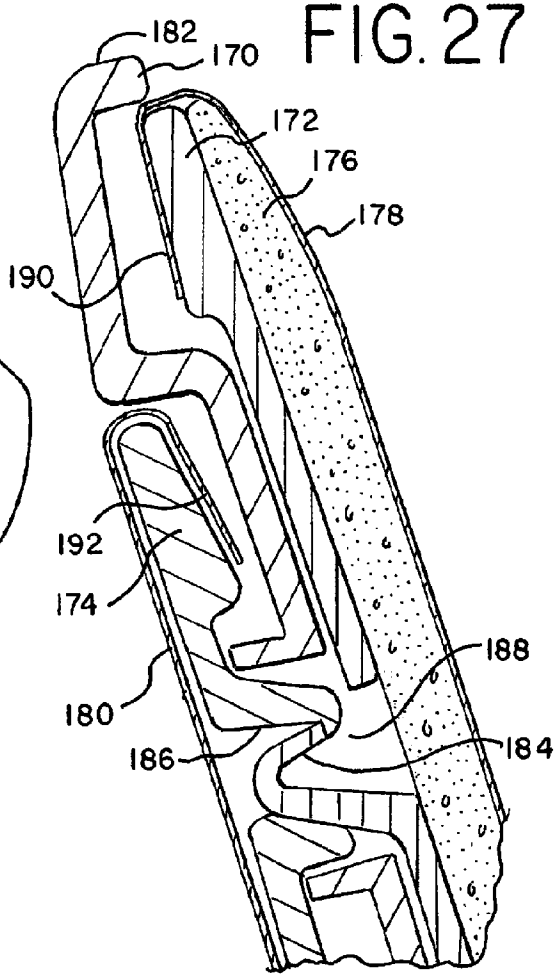
FIG. 27 is a cross-sectional view of an upper portion of the backrest shown in FIG. 26.
Figure 26:
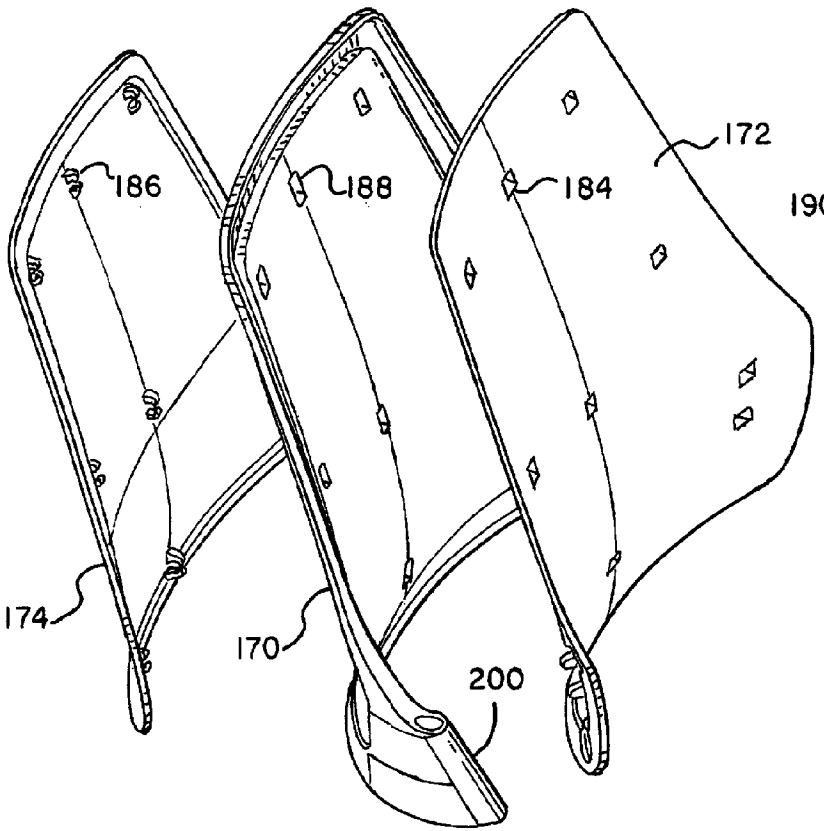
FIG. 26 is a perspective view of an upholstered backrest configuration.

In another embodiment, shown in FIGS. 25-27, the backrest member includes a shell 170 coupled to front and rear inserts 172, 174. A layer of foam 176 covers the front, with fabric 178, 180 then covering the foam and the rear insert. A peripheral edge 182 of the shell remains exposed. The inserts each include a plurality of resilient tab members 184, 186 that extend through openings 188 formed in the shell 170. The resilient tab members 184, 186 are engaged with a snap fit to complete the assembly, sandwiching the shell 170 between the inserts. The front fabric layer 178 covers the foam layer 176 and has an edge portion 190 that extends into a spaced formed between the shell 170 and the front insert 172. Likewise, the rear fabric layer 180 has an edge portion 192 that extends into a spaced formed between the rear insert 174 and the shell 170. The fabric layers may be stapled, glued or both to the inserts. Again, the backrest assembly has a shape similar to that shown in the other embodiments, but with the mounting portion 200 at the junction of the side and bottom edges being the sole mounting portion, such that the curved support and upper supports may be eliminated. The mounting portion 163 engages a post 58, or other like support structure.

Figure 29:
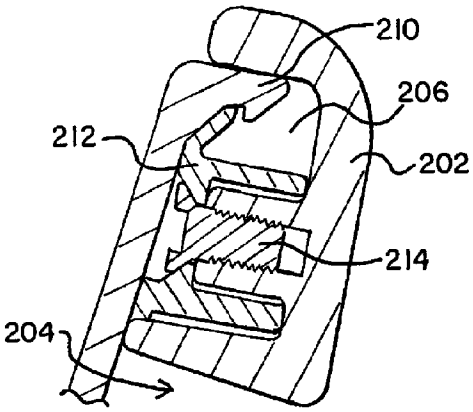
FIG. 29 is a cross-sectional view of a connection between a frame and a flexible member.
Figure 28:
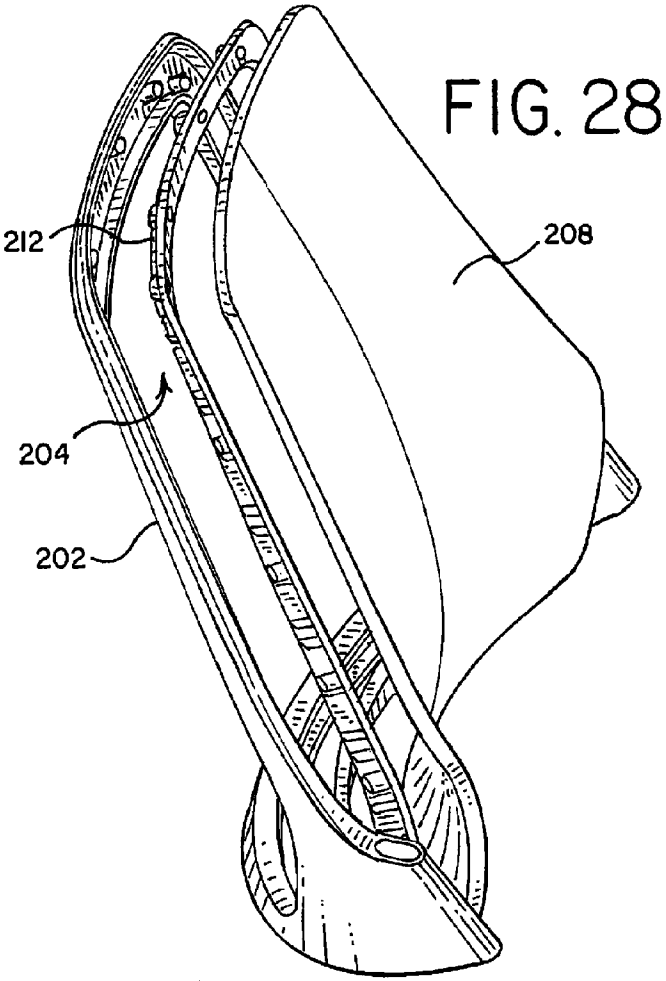
FIG. 28 is a perspective view of a flexible backrest configuration including a peripheral frame.
Figure 31:
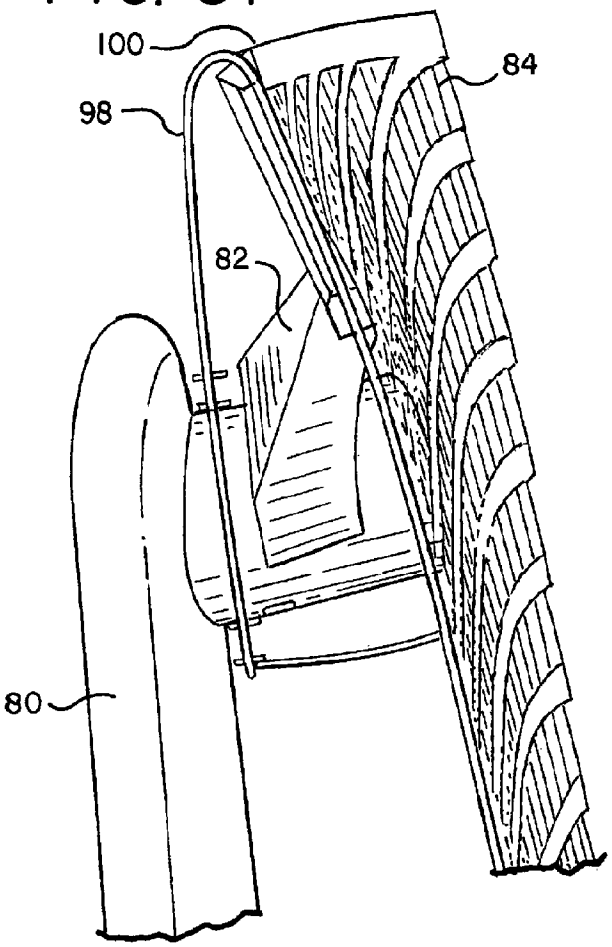
FIG. 31 is a side, schematic view of the connection shown in FIG. 30.
Figure 30:
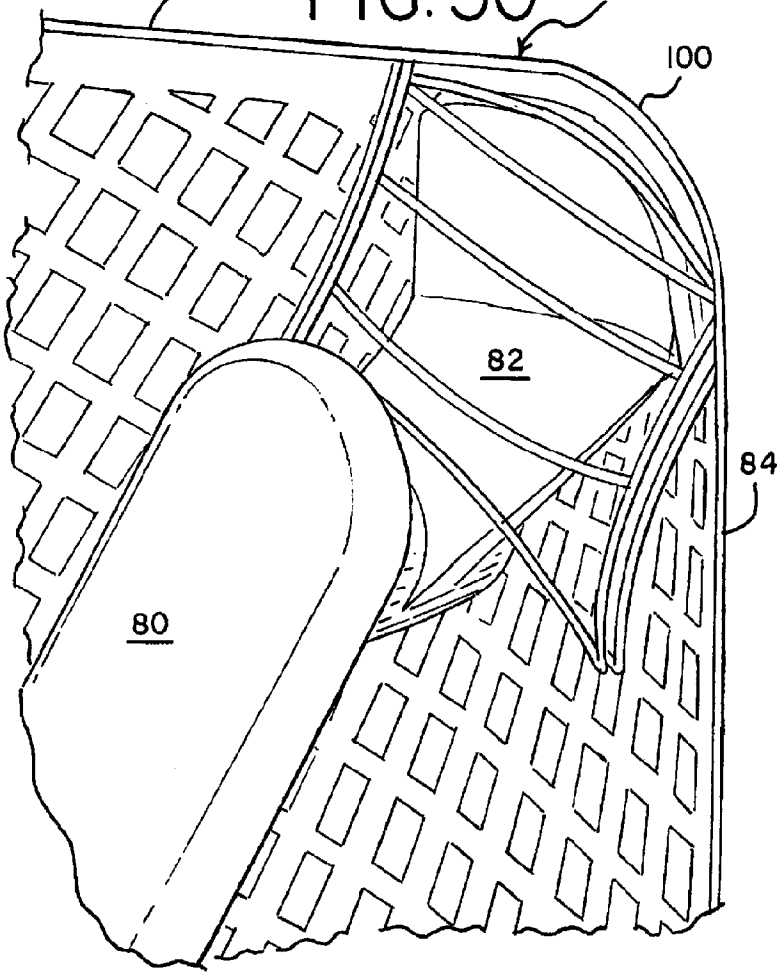
FIG. 30 is a partial view of the connection between a frame and a flexible member.

In yet another embodiment, shown in FIGS. 25 and 29, a peripheral frame 202 is provided that forms a central opening 204, and which has a channel 206 formed around a forwardly facing periphery thereof. A flexible member 208, such as the elastomeric material, membrane or fabric disclosed above, is provided with a peripheral edge portion 210. A retainer 212 includes an edge portion 213 that engages the edge portion 210 of the flexible member and holds the flexible member in and against the frame channel 206. Fasteners 214, such as screws, tabs, snap-fit, etc. couple the retainer 2312 to the frame 202, with the flexible member 208 disposed and trapped therebetween. Again, the backrest assembly has a shape similar to that shown in the other embodiments, but with the mounting portion at the junction of the side and bottom edges being the sole mounting portion, such that the curved support and upper supports may be eliminated. The mounting portion engages a post, or other like support structure.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A seating structure comprising:

a backrest member comprising a shell having a front body-facing surface and comprising a central, spine region and side regions positioned on opposite sides of said spine region, said backrest member having a plurality of openings formed in at least one of upper, middle and lower portions of said side regions on opposite sides of said spine region, wherein said spine region has a greater rigidity than said side regions, said shell defining upper, lower and side edges of said backrest member wherein said at least some of said openings comprise vertically spaced laterally elongated portions connected with a thinner longitudinal portion, and wherein at least some of said openings have one of an I-beam shape or an hour-glass shape;

an auxiliary support member moveably coupled to said backrest member, said auxiliary support member moveable in front of said front body-facing surface of said backrest member; and a body supporting substrate disposed along said front body-facing surface of said backrest member and covering said auxiliary support member.

2. A seating structure comprising:

a backrest member having a front body-facing surface;

an auxiliary support member moveably coupled to said backrest member, said auxiliary support member vertically moveable in front of said front body-facing surface of said backrest member between first and second vertical positions, wherein said auxiliary support member is moved forwardly relative to said backrest member from a first position to a second position as said auxiliary support member is moved from said first vertical position to said second vertical position; and a body supporting substrate disposed along said front body-facing surface of said backrest member and covering said auxiliary support member.

3. The seating structure of claim 1 wherein said backrest member comprises a shell having said front body-facing surface, said shell further comprising opposite side edges and a cutout formed in a central lower region of said front body-facing surface between said side edges, and defining a pad portion disposed in said cutout and coupled to opposite side portions with a pair of connectors laterally spaced on opposite sides of said pad portion, wherein said pad portion is pivotable about said pair of connectors relative to said opposite side portions.

4. The seating structure of claim 3 wherein said auxiliary support member is moveable coupled to said pad portion.

5. The seating structure of claim 2 wherein said backrest member comprises a shell defining upper, lower and side edges of said backrest member; and wherein said body supporting substrate has upper, lower and side edges proximate said upper, lower said side edges of said backrest member; and further comprising a handle configured to be coupled to said auxiliary support member and gripped to move said auxiliary support member between and relative to said backrest member and said body supporting substrate; and a lock component configured to be coupled to said auxiliary support member and prevent movement of said auxiliary support member between and relative to said backrest member and said body supporting substrate.

6. The seating structure of claim 5 wherein said handle and said lock component are configured to be releasably coupled to said auxiliary support member.

7. The seating structure of claim 2 wherein said backrest member comprises a shell having said front body-facing surface and comprising a central, spine region and side regions positioned on opposite sides of said spine region, said backrest member having a plurality of openings formed in at least one of upper, middle and lower portions of said side regions on opposite sides of said spine region, wherein said spine region has a greater rigidity than said side regions, said shell defining upper, lower and side edges of said backrest member.

8. The seating structure of claim 7 wherein said middle portion has a greater rigidity than said upper and lower portions.

9. The seating structure of claim 7 wherein said at least some of said openings comprise vertically spaced laterally elongated portions connected with a thinner longitudinal portion.

10. The seating structure of claim 2 wherein at least one of said backrest member or said auxiliary support member comprises a ramp engaging the other of said backrest member or said auxiliary support member as said auxiliary support member is between first and second vertical positions.

* * * * *